US005692399A

United States Patent [19]

Takahashi et al.

[11] Patent Number: 5,692,399

[45] Date of Patent: Dec. 2, 1997

[54] METHOD OF KNITTING FABRIC HAVING THREE-DIMENSIONAL SILHOUETTE SHAPE

[75] Inventors: Nobuyasu Takahashi; Masao Okuno, both of Wakayama, Japan

[73] Assignee: Shima Seiki Mfg., Ltd., Wakayama, Japan

[21] Appl. No.: 282,007

[22] Filed: Jul. 29, 1994

Related U.S. Application Data

[63] Continuation-in-part of Ser. No. 907,469, Jul. 1, 1992, abandoned.

[30] Foreign Application Priority Data

Jul. 5, 1991 [JP] Japan ..... 3-192652

[51] Int. Cl.[6] ..... D04B 7/10

[52] U.S. Cl. ..... 66/70; 66/76; 66/170

[58] Field of Search ..... 66/30, 32, 70, 66/73, 60, 64, 76, 75.1, 176, 170

[56] References Cited

U.S. PATENT DOCUMENTS

| | | | |
|---|---|---|---|
| 2,616,275 | 11/1952 | Bennington | 66/70 |
| 3,668,896 | 6/1972 | Betts et al. | 66/176 X |
| 3,668,898 | 6/1972 | Betts et al. | 66/70 |

*Primary Examiner*—C. D. Crowder
*Assistant Examiner*—Larry D. Worrell, Jr.
*Attorney, Agent, or Firm*—Edwin E. Greigg; Ronald E. Greigg

[57] ABSTRACT

The present invention provides a knitted fabric of three-dimensional silhouette shape which comprises a front half and a back half coupled at side edges to each other forming a tubular shape and in which the circumferential length of the tubular shape is varied by increasing and/or decreasing the number of wales of one of the two, front and back, halves and also, a method of knitting the same.

6 Claims, 18 Drawing Sheets twisted

METHOD OF KNITTING FABRIC HAVING THREE-DIMENSIONAL SILHOUETTE SHAPE

This is a continuation-in-part of application Ser. No. 07/907,469 filed on Jul. 1, 1992 now abandoned.

BACKGROUND OF THE INVENTION (1) Field of the Invention

The present invention relates to a method of knitting a tubular fabric having a three-dimensional silhouette shape.

(2) Prior Art

Using a common flat knitting machine, a tubular fabric is produced by the steps of knitting a front half of the tubular fabric from yarn threaded onto knitting needles of the front needle bed and knitting a back half from the yarn threaded onto the rear needle bed. The back half is joined at both side ends thereof to the front half. Such steps are repeated a number of times for forming a tubular shape.

In common, such tubular fabrics are finished as garments, e.g., sweaters, tights or pants.

The tubular fabric can be adjusted diametrically or circumferentially by increasing and/or decreasing the number of the knitting needles to be used or, more specifically, by varying the number of wales.

When the circumference is increased by increasing in succession the number of the knitting needles used, the tubular shape can be turned into, for example, a sleeve having a wide cuff.

An example for shortening the circumferential length by decreasing the number of the knitting needles to be used is discussed in Japanese patent laid-open publication 1-229248, in which a body portion and two sleeve portions are gradually reduced or tapered in width from the armpits while being knitted separately.

The prior art method is successfully applicable to knitting of a front-to-back symmetrical shape, e.g., a gourd shape. However, if a tubular fabric is designed for producing a sweater or one-piece garment, it should have a front half which is enlarged at the breast for a real human body though a back half is knitted substantially flat for fit to the flat back of the human body.

In the prior art, the enlarged portion of the front half is knitted by first increasing the number of wales and then decreasing the same so as to apply the enlarged portion to the front half. This method results in the number of wales of the front half being different from that of back half. Where the front half and the back half are joined to each other, both ends of the front half having wales greater than the back half are stretched towards the back half. As a result, the seams between the two halves become long.

Where such a tubular fabric is used for a garment, for example, a sweater, tights or pants, it appears that the garment looks split at the seams between the front half and the back half since the seams are elongated due to stretching.

The present invention is based on the prior art of knitting a tubular fabric of three-dimensional silhouette shape with a flat knitting machine having an upper front needle bed, a lower front needle bed, an upper rear needle bed and a lower rear needle bed comprising knitting a tubular fabric consisting of a front part knitted by front knitting needles and a back part knitted by rear knitting needles, and selecting a different number of the front knitting needles used for knitting the front part than the number of the rear knitting needles used for knitting the back part to produce a different number of wales of the front part from the number of wales of the back part.

Therefore, the theme of this invention is how to minimize the actual difference of wales between the front half and the back half after using the above-mentioned knitting steps.

SUMMARY OF THE INVENTION

An object of the present invention is to provide a method of knitting a tubular fabric of three-dimensional silhouette shape for producing a tubular fabric which is not loose, elongated or possessed of twisted loops at the joint between the front and back halves.

To achieve the above object, the application discloses a method of knitting a tubular fabric of three-dimensional silhouette shape using a flat knitting machine having an upper front needle bed, a lower front needle bed, an upper rear needle bed and a lower rear needle bed, including the step of knitting a tubular fabric consisting of a front part knitted by front knitting needles and a back part knitted by rear knitting needles.

In particular, the method comprises the steps of selecting a different number of the front knitting needles used for knitting the front part from that of the number of the rear knitting needles used for knitting the back part to produce a different number of wales of the front part from that of the number of wales of the back part, feeding a yarn to the knitting needles holding a loop to be transferred, twisting the loop in a direction opposite to one for feeding the yarn to the knitting needles of the needle bed having the greater number of wales for knitting the tubular fabric, and transferring the twisted loop held on the knitting needle to a confronting knitting needle of the needle bed having the lesser number of wales.

Therefore, where using a known "4-bed" knitting machine provided with upper-front, lower-front, upper-rear, and lower-rear needle beds, the front of, for example, a sweater is knitted on one of the front or rear needle beds while the back half is knitted on the opposite needle bed while being joined to the front half so that a tubular shape can be produced.

For forming an enlarged breast region of the front half, the number of wales in the front half is increased in steps by a degree corresponding to the size of the raised region while the wales in the back half remain unchanged.

In order to minimize a difference in the number of wales between the front and back halves, loops at both side edges of the front half are transferred to the back half.

To form new loops a yarn is fed to the loops, which have been transferred to the back half, and the new loops return to the front half. According to a certain condition of using the above-mentioned knitting machine, the new loops are twisted when they return to the front half due to the direction of feeding the yarn to the loops which have been transferred to the back half.

To solve the problem created by the twist of the new loops, when the loops are transferred to the back half, the loops are twisted in advance in a direction which may prevent the new loops from being twisted when they return to the front half.

Therefore, the present invention has an advantage of producing a tubular fabric which does not possess loose or elongated seams or twisted loops at the joint between the front and back halves.

Further, another method of knitting a tubular fabric of three-dimensional silhouette shape according to the present invention is disclosed also involving knitting a tubular fabric consisting of a front part and a back part with a flat knitting machine having an upper front needle bed, a lower front needle bed, an upper rear needle bed and a lower rear needle bed, and in which the front part and the back part are joined at their sides, including the steps of selecting a different number of the front knitting needles used for knitting the front part than the number of the rear knitting needles used for knitting the back part to produce a different number of wales of the front part from the number of wales of the back part, hooking a yarn by a knitting needle of the needle bed having a lesser number of wales which holds no loop, in which said knitting needle confronts a knitting needle which holds a loop to be transferred, feeding the yarn to the knitting needles of the needle bed having the larger number of wales, except to the knitting needles having the loop to be transferred, transferring, in a state of twist, the hooked yarn to the confronting knitting needle holding the loop to be transferred, and returning the hooked yarn to the knitting needle of the needle bed having the lesser number of wales by knocking over the loop to be transferred.

The method also provides a tubular fabric which has no loose, elongated or twisted loops at the joint between the front and back halves.

Other objects and advantages will be apparent from the following description of the preferred embodiment accompanying the drawings.

BRIEF DESCRIPTION OF THE DRAWINGS

The drawings show embodiments of a method of knitting a tubular fabric of three-dimensional silhouette shape according to the present invention in which.

DETAILED DESCRIPTION OF THE EMBODIMENTS

Tubular knitted fabrics of a three-dimensional silhouette form and a method of knitting the same according to the present invention will be described referring to the accompanying drawings.

As not particularly shown, a knitting machine employed for implementation of the embodiments is a so-called "four-bed flat knitting machine" which comprises two pairs of front and rear needle beds arranged upper and lower and a carriage of single lock type having both knitting lock and transfer lock in the same phase.

Figure 1:
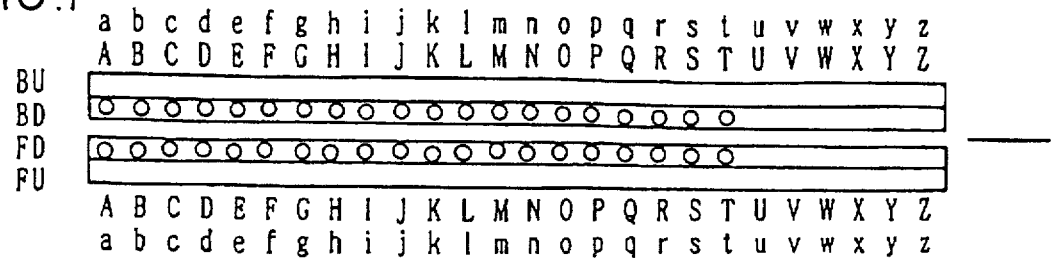
FIG. 1 illustrates a course of knitting a straight portion of a tubular knitted fabric according to the present invention.
Figure 73:
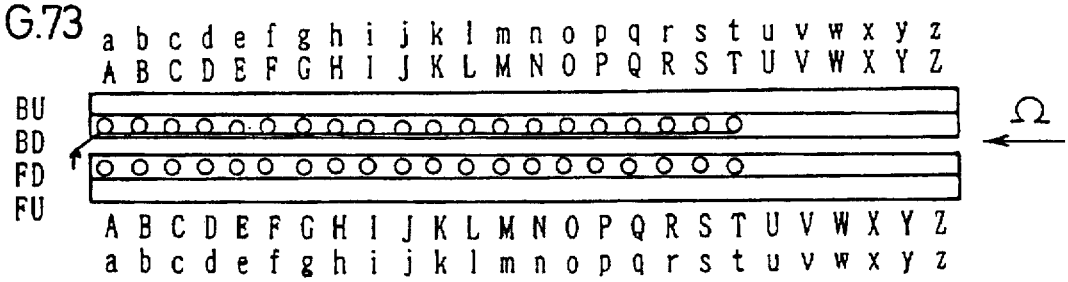

FIGS. 1 to 73 illustrate a series of courses for knitting procedure, in which the lower front needle bed is denoted by FD, the upper front needle bed by FU, the lower rear needle bed by BD, and the upper rear needle bed by BU. Also, the alphabetic capital letters A to Z represent knitting needles on the lower needle beds and the small letters a to z represent knitting needles on the upper needle beds.

It is assumed that each knitted fabric is fabricated by plain knitting with the use of a minimum number of the knitting needles for ease of description.

Figure 75:
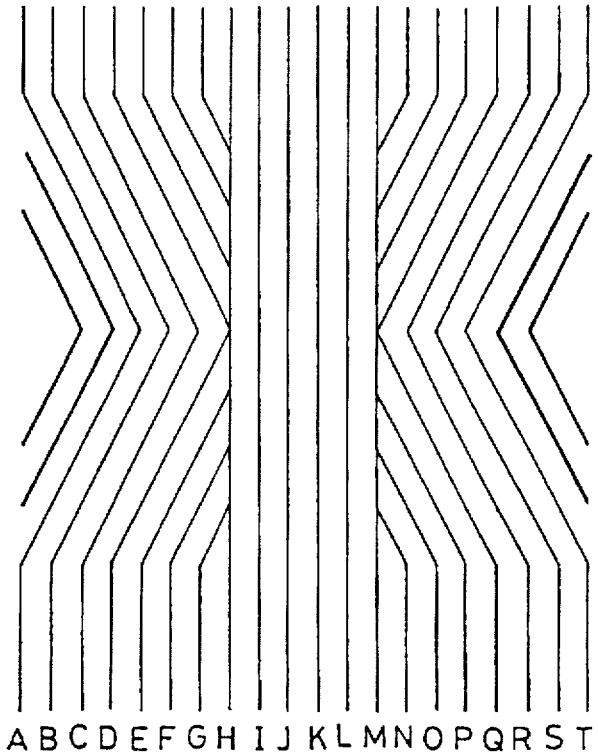
FIG. 75 is a front view of the constricted portion of the tubular knitted fabric produced by the method of the present invention.

According to the present invention, a tubular fabric shaped symmetrical front to rear is knitted using a thread of yarn fed in the counter-clockwise direction. In operation the number of wales of a front half of the fabric is first reduced in steps to shorten the circumferential length and then, increased thus forming a constricted part of the tubular fabric along a waistline, as shown in FIG. 75.

Figure 2:
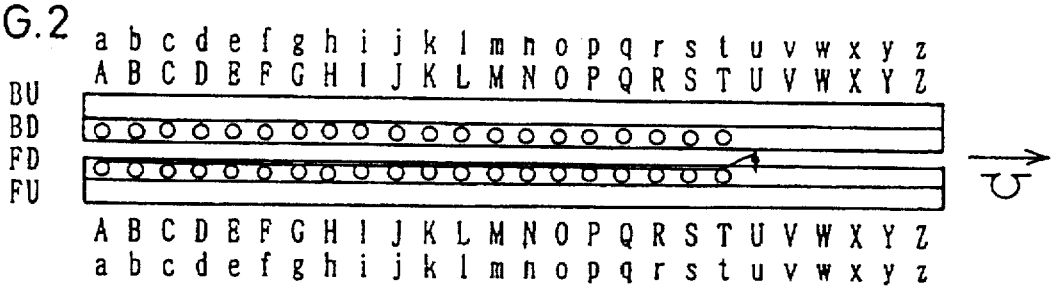
FIGS. 2 and 3 show courses of preparation for starting a constricted portion in succession to the straight portion.

A straight portion of the tubular fabric is produced by coupling both side ends to each other which are hung on the knitting needles (A and T) of their respective lower needle beds FD and BD, as shown in FIG. 2.

In FIG. 2, as the carriage runs to the right, the yarn is fed to make a row of loops on the knitting needles A to T of the lower front needle bed FD. Then, as the carriage runs back to the left, another row of loops are produced on the knitting needles T to A of the lower rear needle bed BD, as shown in FIG. 3.

Figure 3:
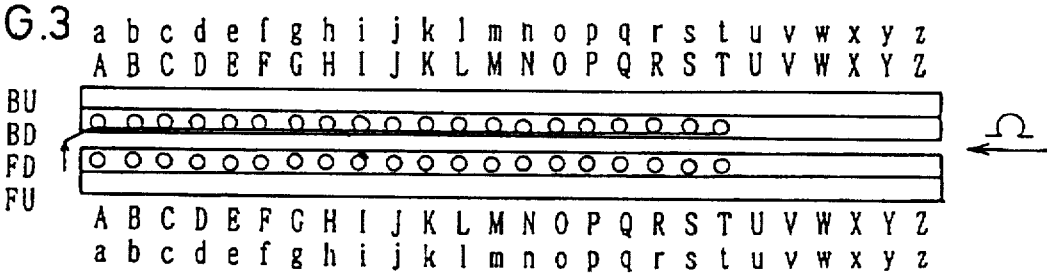
Figure 4:
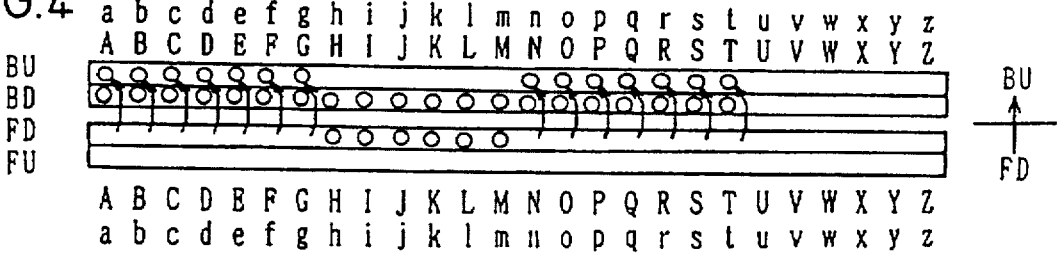
FIGS. 4 to 32 show courses of decreasing the number of wales to shorten the circumferential length for knitting a first half of the constricted portion of the tubular knitted fabric.

After repeating once again the two courses shown in FIGS. 2 and 3, the loops of yarn on the knitting needles A to G and N to T of the lower front needle bed FD are transferred onto the knitting needles a to g and n to t of the upper rear needle bed BU, as shown in FIG. 4.

The repeating of the courses of FIGS. 2 and 3 is for a decrease in at least every two courses in order to avert twisting of loops during transfer from needles to other needles.

Figure 5:
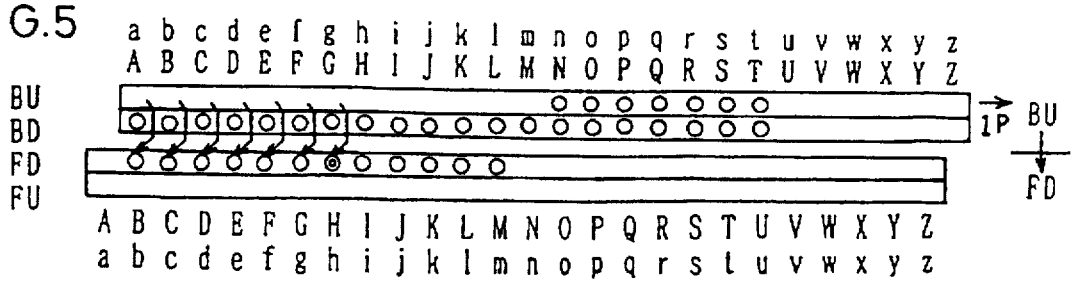

As shown in FIG. 5, the two rear needle beds BD,BU are moved one knitting needle distance to the right by racking and the loops on the knitting needles a to g of the upper rear needle bed BU are transferred onto the knitting needles B to H of the lower front needle bed FD so that two loops of the yarn overlap with each other on the knitting needle H of the lower front needle bed FD.

Figure 6:
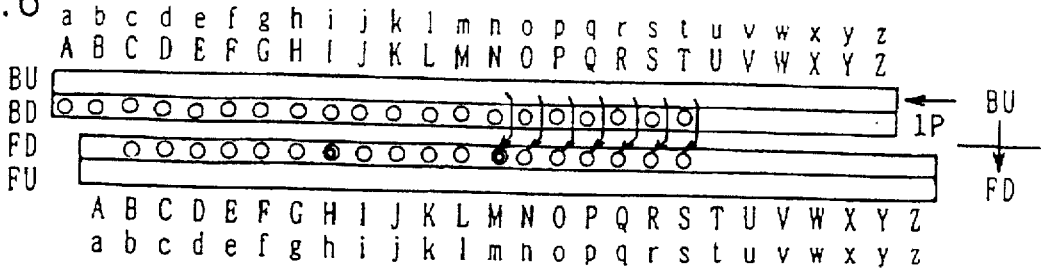

Then, the two rear needle beds BD,BU are moved back one knitting needle distance to the left by racking and the loops on the knitting needles n to t of the lower rear needle bed BD are transferred onto the knitting needles M to S of the lower front needle bed FD so that the loop from the knitting needle n of the lower rear needle bed BD can be placed over the loop hung on the knitting needle M of the lower front needle bed FD, as shown in FIG. 6.

Figure 7:
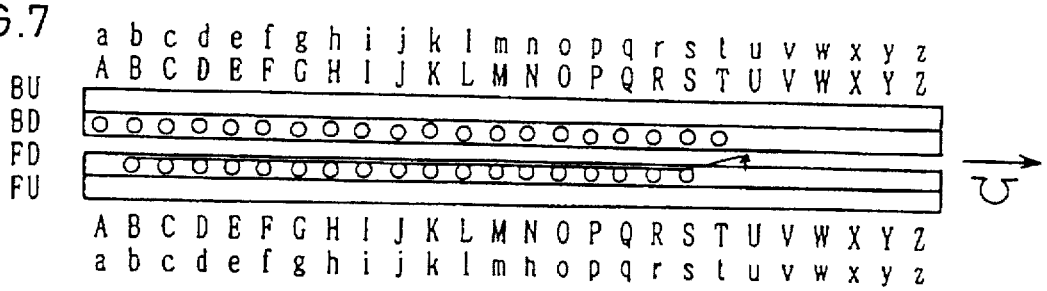

In succession, as shown in FIG. 7, the yarn is fed to form loops on the knitting needles B to S of the lower front needle bed FD. Accordingly, the loops hung on the knitting needles A to T of the lower front needle bed FD shown in FIG. 1 are reduced by two to hang on the knitting needles B to S.

After the yarn is fed to form loops on the knitting needles T to B of the lower rear needle bed BD as shown in FIGS.

Figure 9B:
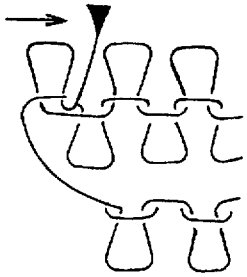
Figure 9A:
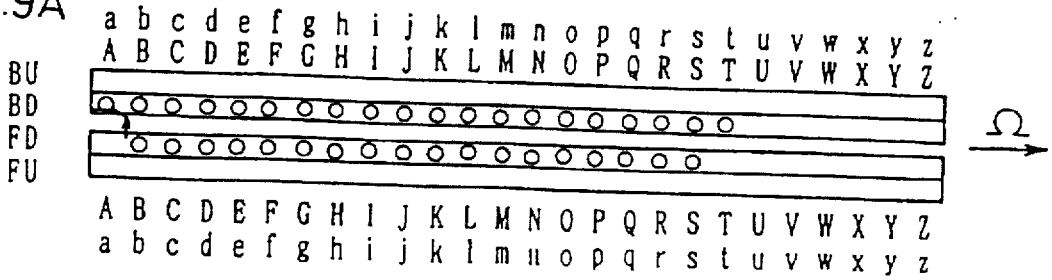

8a and 8b, it is threaded back from left to right thus forming a loop on the knitting needle A of the same, as shown in FIGS. 9a and 9b.

Figure 10A:
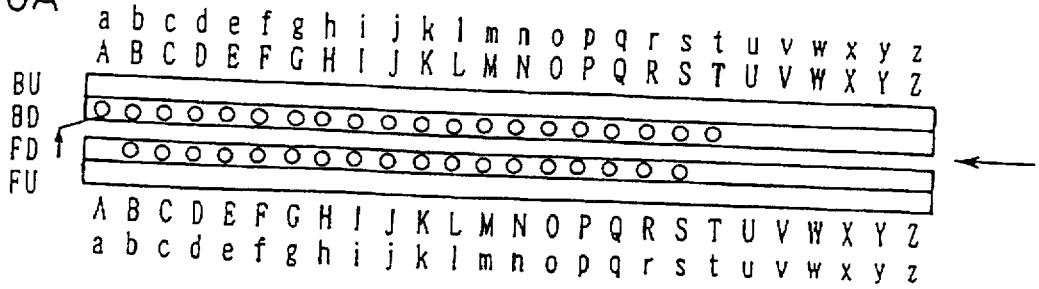
Figure 10B:
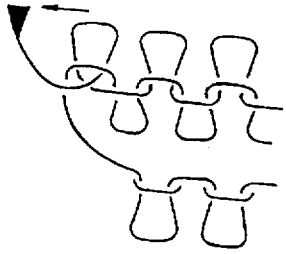
Figure 11B:
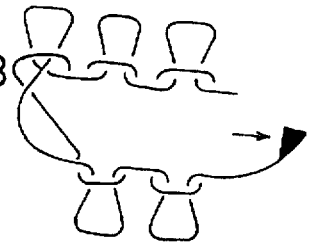
Figure 11A:
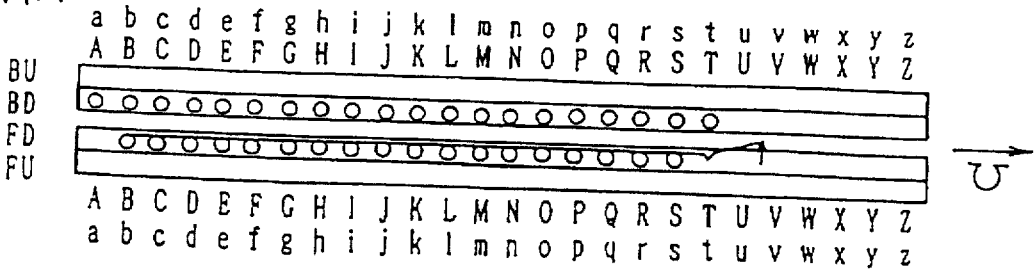

As shown in FIGS. 10a and 10b, the feeder which forms a loop on the knitting needle A of the lower rear needle bed BD is displaced out from the knitting area of the machine and then, the yarn is fed to form a row of loops on the knitting needles B to S of the lower front needle bed FD, as shown in FIGS. 11a and 11b, while the knitting needle T remains unoccupied where the yarn is tucked.

Figure 12:
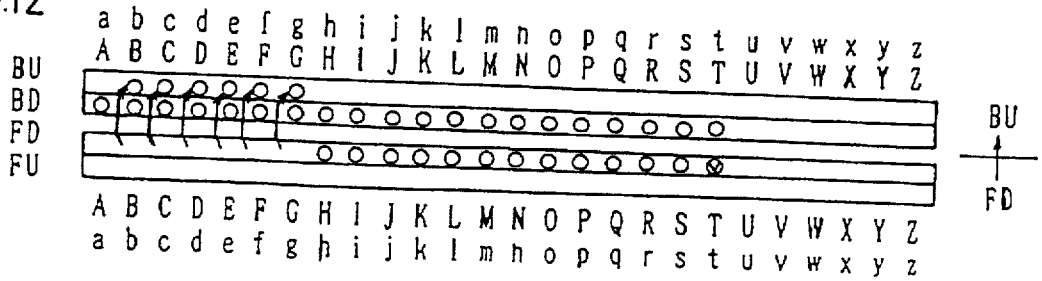
Figure 13A:
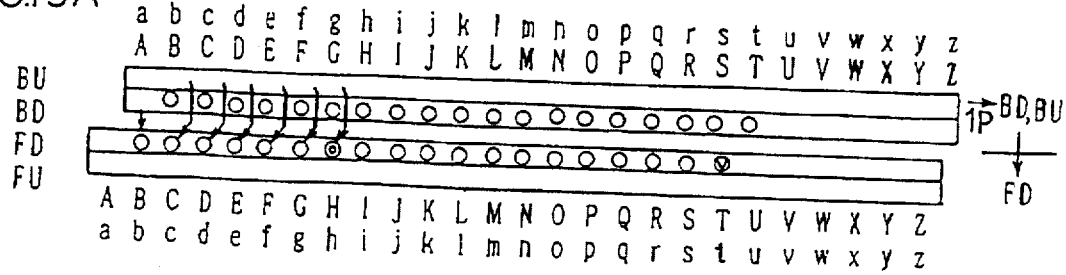
Figure 13B:
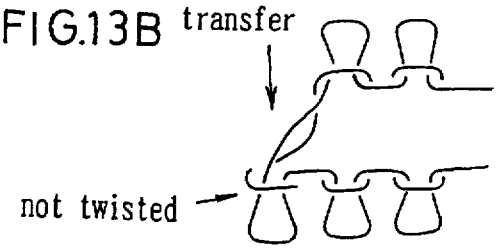

Then, the loops on the knitting needles B to G of the lower front needle bed FD are transferred onto the knitting needles b to g of the upper rear needle bed BU, as shown in FIG. 12. The two rear needle beds BD,BU are moved one knitting needle distance to the right, as shown in FIGS. 13a and 13b, and the loops on the knitting needles b to g of the upper rear needle bed BU are transferred onto the knitting needles C to H of the lower front needle bed FD so that two loops of the yarn overlap with each other on the knitting needle H of the lower front needle bed FD. Simultaneously, the loop on the knitting needle A of the lower rear needle bed BD is transferred onto the knitting needle B of the lower front needle bed FD.

Figure 8A:
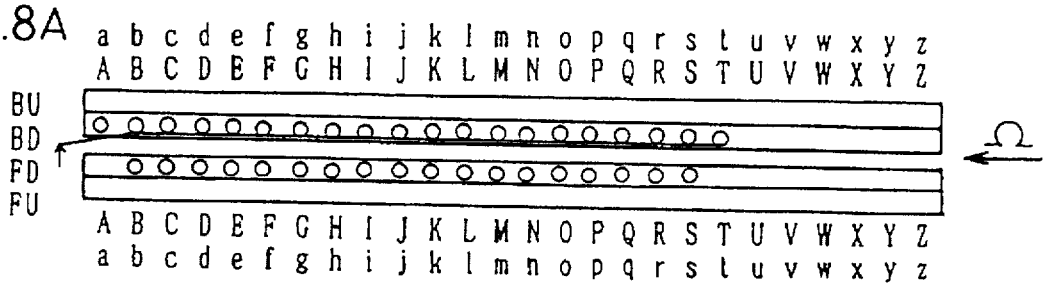
Figure 8B:
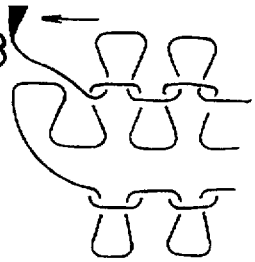
Figure 74:
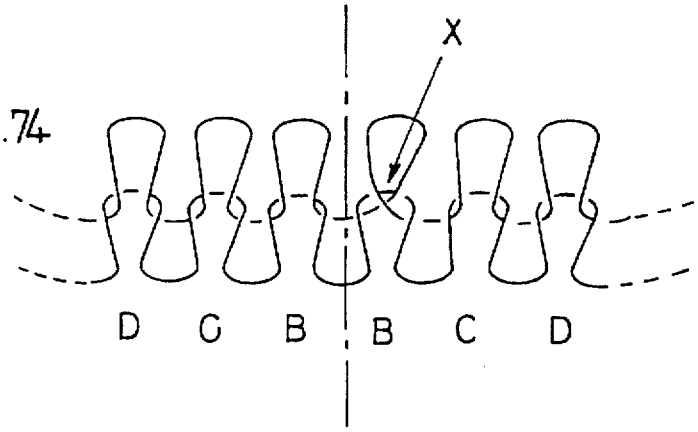
FIG. 74 is a schematic view of a knitted fabric produced by a method other than the method of the present invention.

It should be noted that if the yarn is threaded from the knitting needle T to B of the lower rear needle bed BD, as shown in FIGS. 8a and 8b, and the knitting procedure shown in FIGS. 9a and 9b is not carried out, the loop on the knitting needles B of the front needle bed FD, as shown in FIGS. 13a and 13b, becomes twisted as denoted by the arrow x in FIG. 74.

Figure 14B:
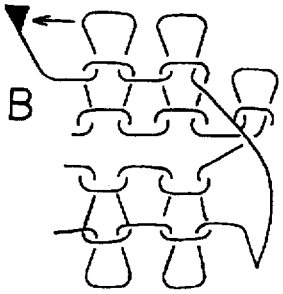
Figure 14A:
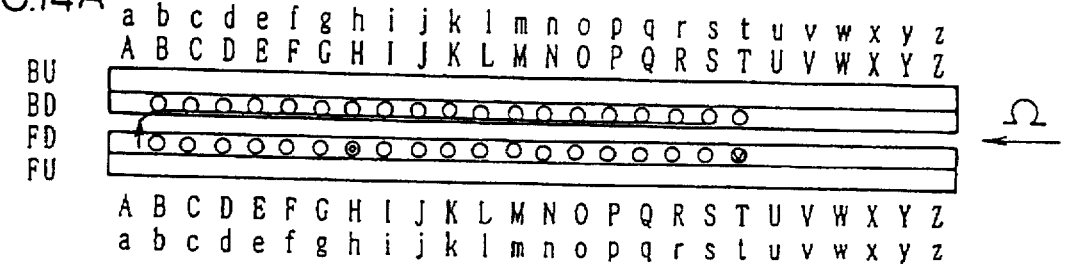

As shown in FIGS. 14a and 14b, the two rear needle beds BD/BU are then returned one knitting needle distance to the left and the yarn is fed to form a further row of loops on the knitting needles S to B of the lower rear needle bed BD.

Figure 15A:
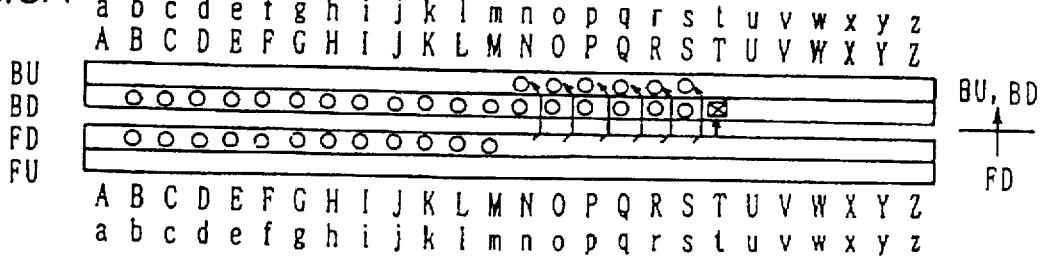
Figure 15B:
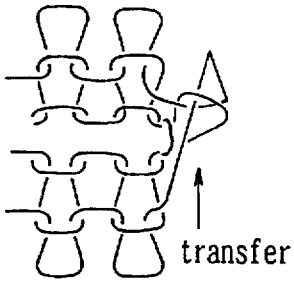

The loops on the knitting needles N to S of the lower front needle bed FD are transferred onto the knitting needles n to s of the upper rear needle bed BU, as shown in FIGS. 15a and 15b, and also, the tucked yarn shown in FIGS. 11a and 11b is transferred onto the knitting needle T of the lower rear needle bed BD.

The loops are transferred as knocked over across the loop transferred from the knitting needle T of the lower front needle bed FD to the knitting needle T of the lower rear needle bed BD.

More particularly, if latch needles are used for knitting, the knitting needles for receiving the loops should be arranged to move upward to a height where the loops to be transferred can clear over the distal end of the opening latch of each knitting needle.

If compound needles are used, the loops to be transferred shall be arranged to ride over the slider during the upward movement of the knitting needles for receiving the loops and when the knitting needles move backward, slide on the slider to be knocked over across the tucked yarn.

Figure 16B:
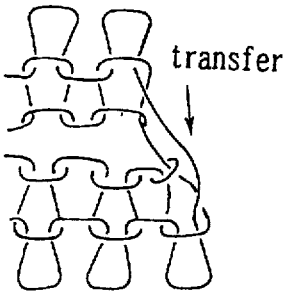
Figure 16A:
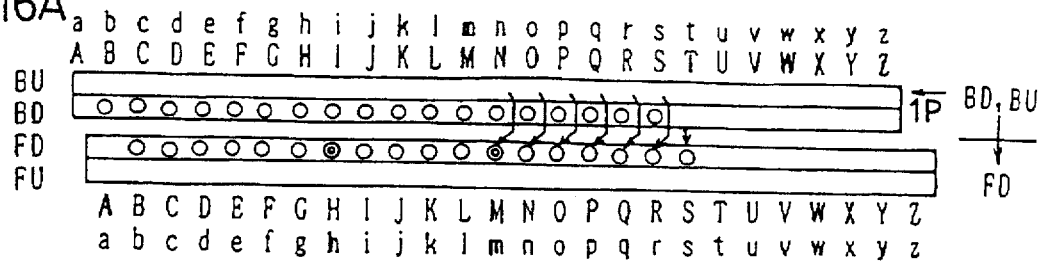

As shown in FIGS. 16a and 16b, the two rear needle beds BD,BU are moved one knitting needle distance to the left by racking and the loops on the knitting needles n to s of the upper rear needle bed BU are transferred onto the knitting needles M to R of the lower front needle bed FD so that two loops overlap with each other on the knitting needle M of the lower front needle bed FD. Simultaneously, the loop on the knitting needle T of the lower rear needle bed is transferred onto the knitting needle S of the lower front needle bed FD.

More particularly, the tucked yarn on the knitting needle T of the lower rear needle bed BD which was not looped at the step of FIGS. 14a and 14b is threaded through the loop carried on the knitting needle T of the lower front needle bed FD for transfer to the knitting needle S of the lower front needle bed FD.

As apparent from FIGS. 11a to 16b, the tucked yarn on the knitting needle T of the lower front needle bed FD becomes a loop of the tubular knitted fabric in the end, as shown in FIGS. 11a and 11b, as in the other loops. Hence, the feeding length of the tucked yarn is preferably equal to the yarn length which forms a unit loop or stitch.

Figure 17:
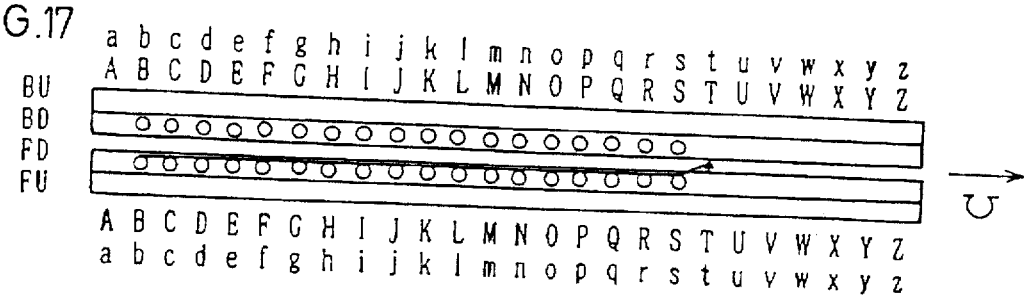
Figure 18:
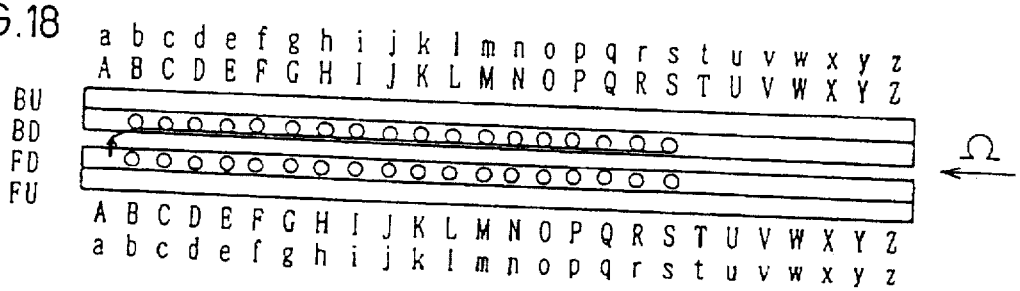

The yarn is fed to form a row of loops on the knitting needles B to S of the lower front needle bed FD, as shown in FIG. 17, and in turn, another row of loops on the knitting needles S to B of the lower rear needle bed BD, as shown in FIG. 18. This action shown in FIGS. 17 and 18 is repeated once more.

Figure 19:
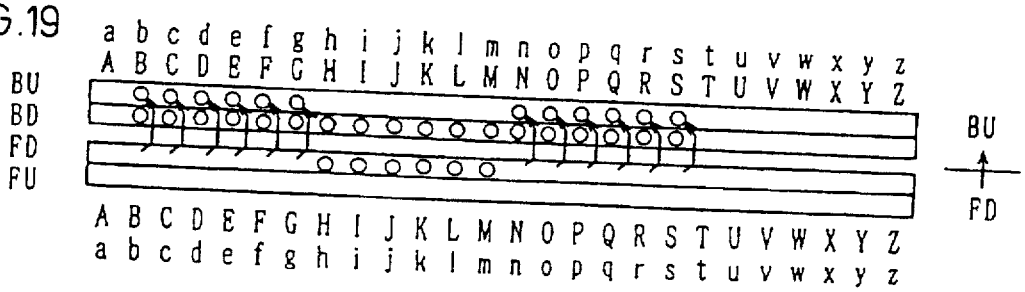
Figure 20:
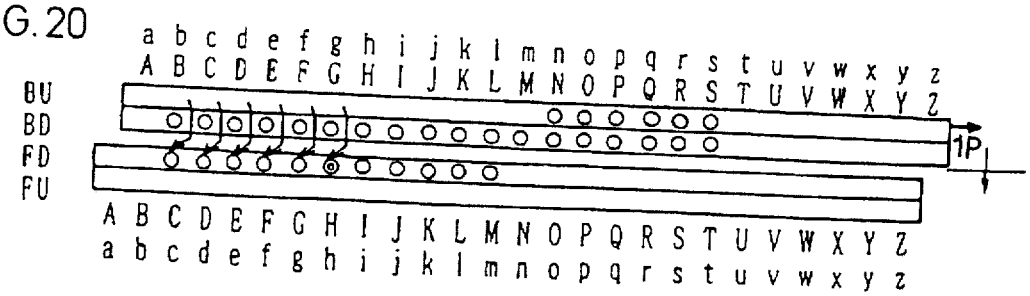

As shown in FIG. 19, the loops on the knitting needles B to G and N to S of the lower front needle bed FD are then transferred onto the corresponding knitting needles b to g and n to s of the upper rear needle bed BU. The two rear needle beds BD,BU are moved one knitting needle distance to the right by racking and the loops on the knitting needles b to g of the upper rear needle bed BU are transferred onto the knitting needles C to H of the lower front needle bed FD so that two loops overlap with each other on the knitting needle H of the lower front needle bed FD, as shown in FIG. 20.

Figure 21:
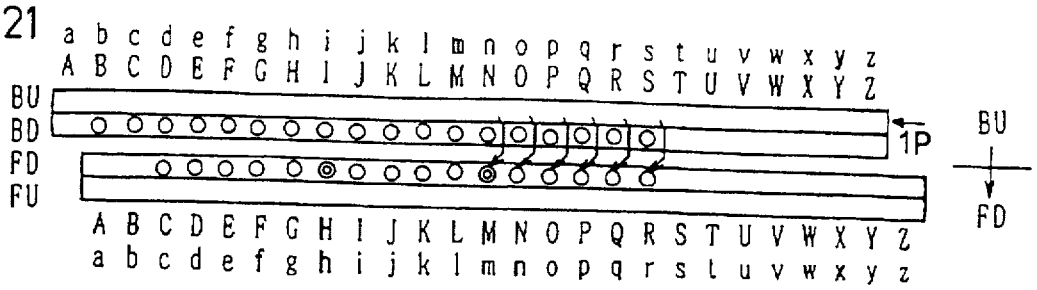

Then, the two rear needle beds BD,BU are moved back one knitting needle distance to the left by racking and the loops on the knitting needles n to s of the lower rear needle bed BD are transferred onto the knitting needles M to R of the lower front needle bed FD so that the loop from the knitting needle n of the lower rear needle bed BD is placed over the loop on the knitting needle M of the lower front needle bed FD, as shown in FIG. 21.

Figure 22:
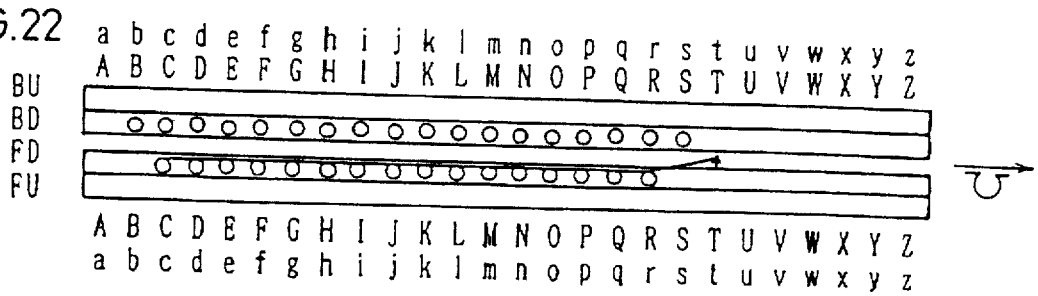

As illustrated in FIG. 22, the yarn is fed to from a row of loops on the knitting needles C to R of the lower front needle bed FD. Accordingly, the row of loops on the knitting needles C to R is two loops less than the preceding row of the loops on the knitting needles B to S of the lower front needle bed FD shown in FIG. 18.

Figure 23:
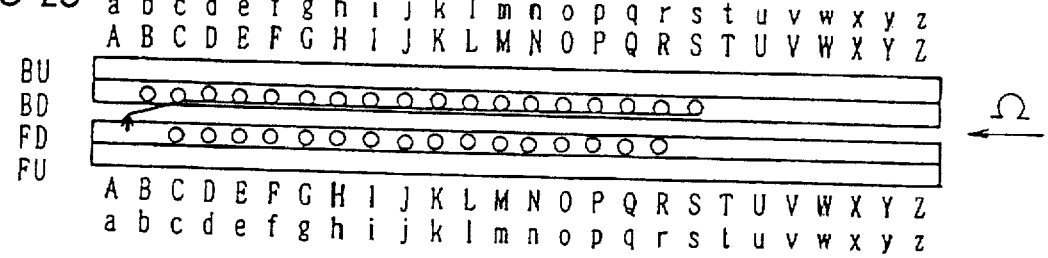
Figure 24:
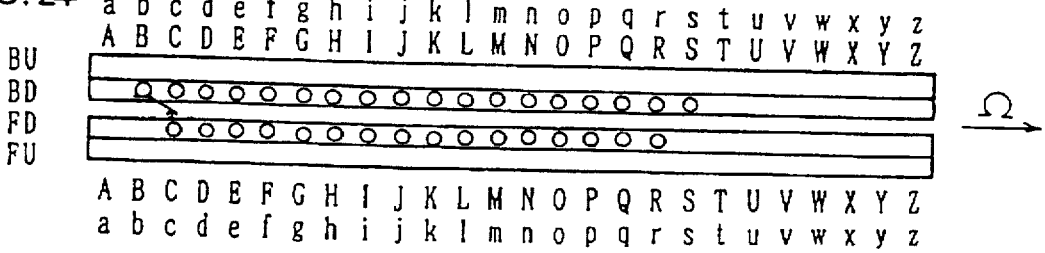

The yarn is fed from right to left to form a row of loops on the knitting needles S to C of the lower rear needle bed BD, as shown in FIG. 23, and then threaded in a reverse direction to form another row of loops starting from the knitting needle B of the lower rear needle bed BD, as shown in FIG. 24.

Figure 25:
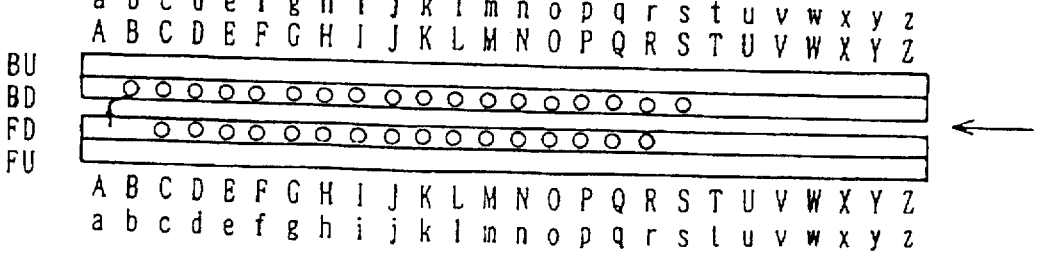
Figure 26:
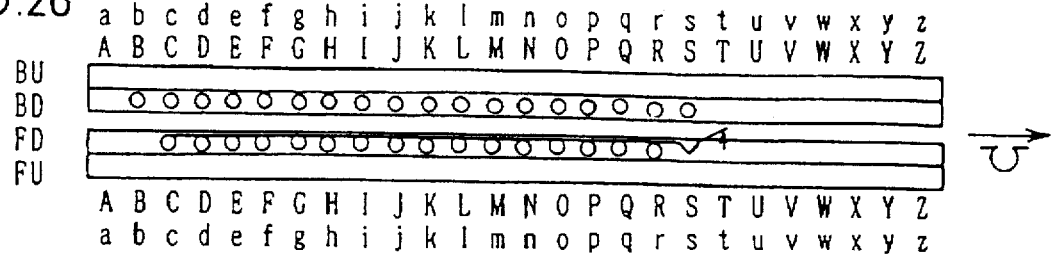

The feeder after threading through the knitting needle A of the lower rear needle bed BD is removed out to the left from the knitting area, as shown in FIG. 25, and the yarn is fed to from a row of loops on the knitting needles C to R of the lower front needle bed FD, as shown in FIG. 26, while the knitting needle S remains unoccupied where the yarn is tucked.

Figure 27:
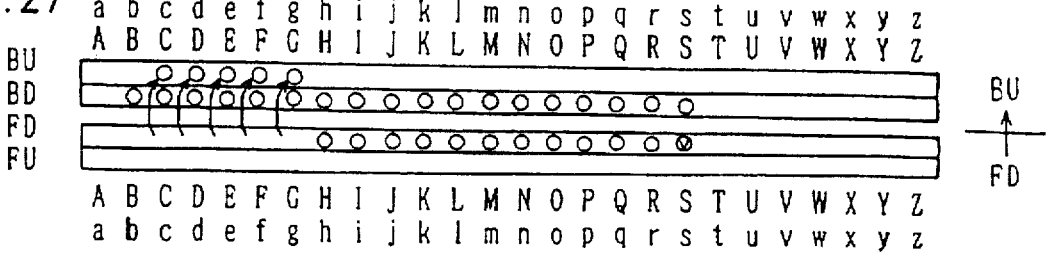
Figure 28:
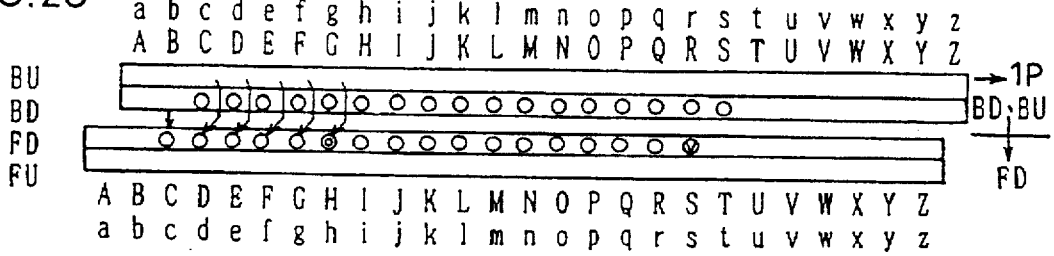

As shown in FIG. 27, the loops on the knitting needles C to G of the lower front needle bed FD are transferred onto the knitting needles c to g of the upper rear needle bed BU. Then, the two rear needle beds BD,BU are displaced one knitting needle distance to the right by racking and the loops on the knitting needles c to g of the upper rear needle bed BU are transferred onto the knitting needles D to H of the lower front needle bed FD so that two loops overlap with each other on the knitting needle H, as shown in FIG. 28. Simultaneously, the loop on the knitting needle B of the lower rear needle bed BD is transferred onto the knitting needle B of the lower front needle bed FD.

Figure 29:
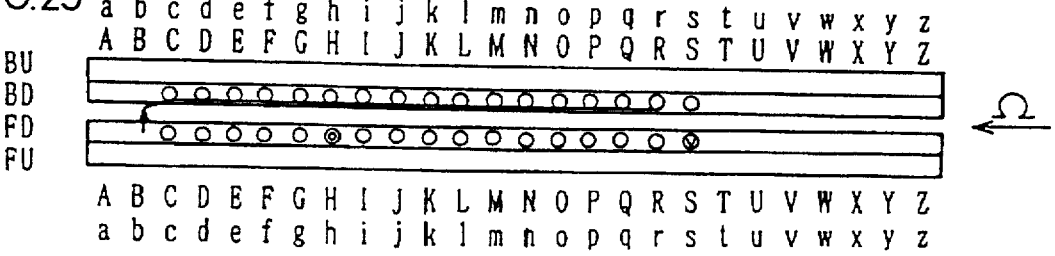

The two rear needle beds BD,BU are moved back to the left by one knitting needle distance and the yarn is fed from a row of loops on the knitting needles R to C of the lower rear needle bed BD, as shown in FIG. 29.

Figure 30:
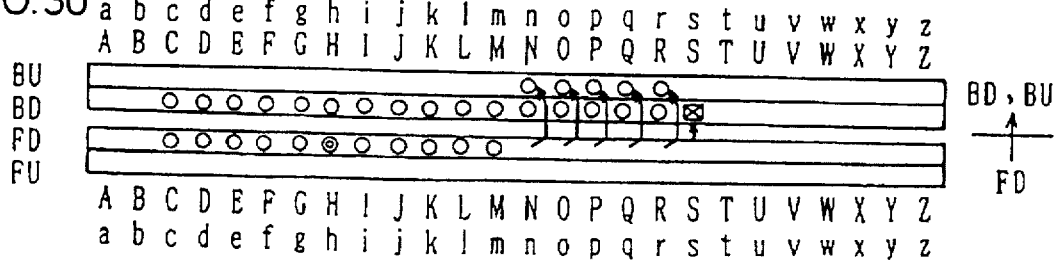

As shown in FIG. 30, the loops on the knitting needles N to R of the lower front needle bed FD are transferred onto the knitting needles n to r of the upper rear needle bed BU. Also, the tucked yarn shown in FIG. 26 is transferred onto the knitting needle S of the lower rear needle bed BD.

For transfer, the loops to the knitting needles of the lower rear needle bed BU are knocked over across the tucked loop transferred from the needle bed FD to the needle bed BD in the same manner as described previously.

Figure 31:
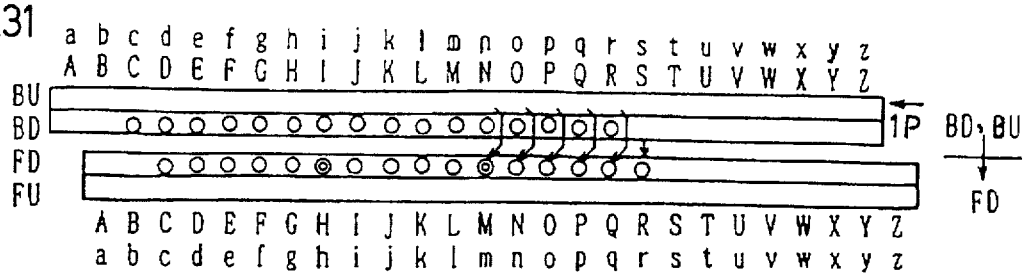

The two rear needle beds BD,BU are moved one knitting needle distance to the left by racking and the loops on the knitting needles n to r of the upper rear needle bed BU are transferred onto the knitting needles M to Q of the lower front needle bed FD so that two loops overlap with each other on the knitting needle M of the lower front needle bed FD, as shown in FIG. 31.

Figure 32:
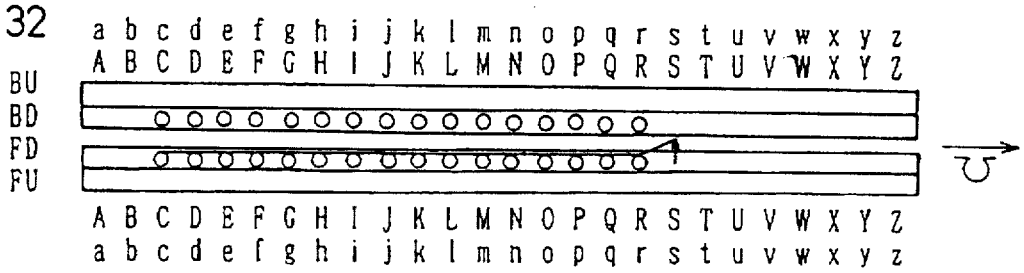
Figure 33:
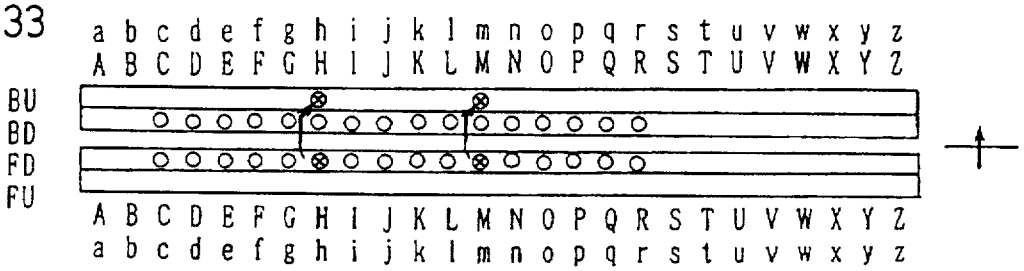
FIGS. 33 to 73 show courses of increasing the number of wales to lengthen the circumferential length for knitting a second half of the constricted portion.
Figure 34:
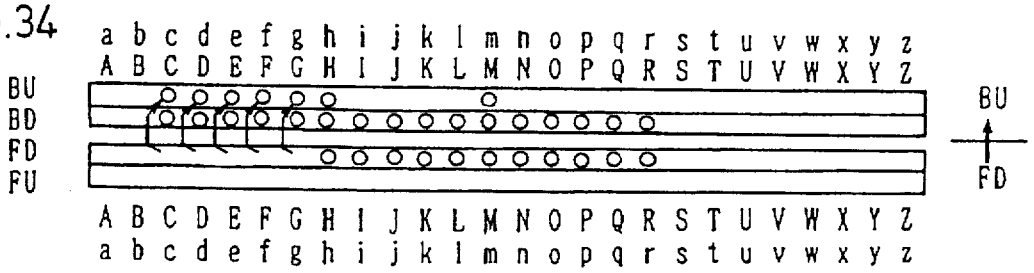

The procedure shown in FIGS. 1 to 31 is repeated a given number of times to reduce the circumferential length of the tubular knitted fabric. Then, the yarn is fed to from a row of loops on the knitting needles C to R of the lower front needle bed FD, as shown in FIG. 32. In succession, the number of wales is increased in the procedure from FIG. 33. More specifically, the two loops are transferred by split stitch from the knitting needles H and M of the lower front needle bed FD to the knitting needles h and m of the upper rear needle bed BU respectively, as shown in FIG. 33. Then, the loops on the knitting needles C to G of the lower front needle bed FD are transferred onto the knitting needles c to g of the upper rear needle bed BU, as shown in FIG. 34.

Figure 35:
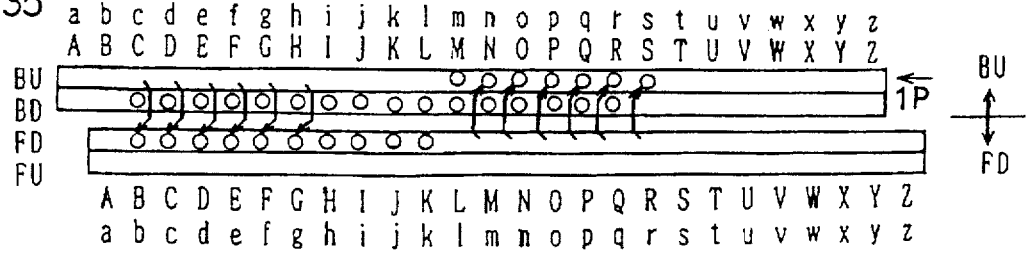

As shown in FIG. 35, the two rear needle beds BD,BU are moved one knitting needle distance to the left by racking and the loops on the knitting needles c to h of the upper rear needle bed BU are transferred onto the knitting needles B to G of the lower front needle bed FD. Simultaneously, the loops on the knitting needles M to R of the lower front needle bed FD are transferred onto the knitting needles n to s of the upper rear needle bed BU.

Figure 36:
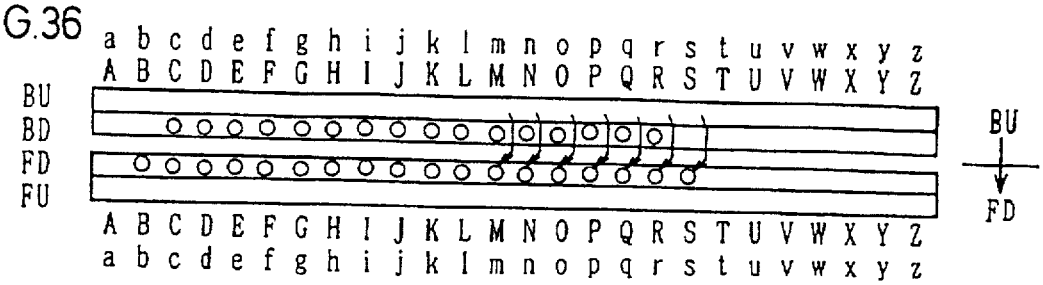

The two rear needle beds BD,BU are moved back to the right by the same distance and the loops on the knitting needles m to s of the upper rear needle bed BU are transferred onto the knitting needles M to S of the lower front needle bed FD, as shown in FIG. 36.

Figure 37:
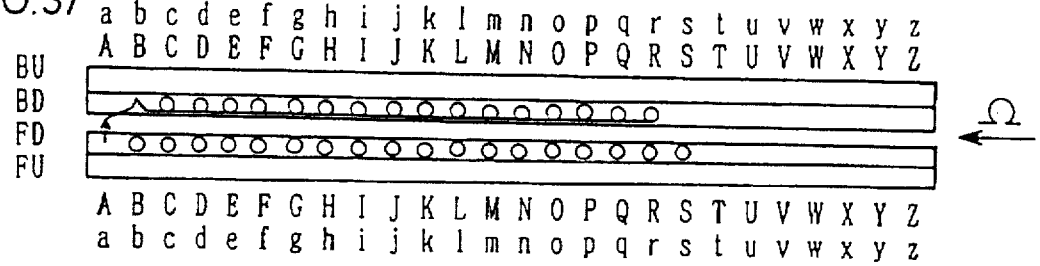
Figure 38:
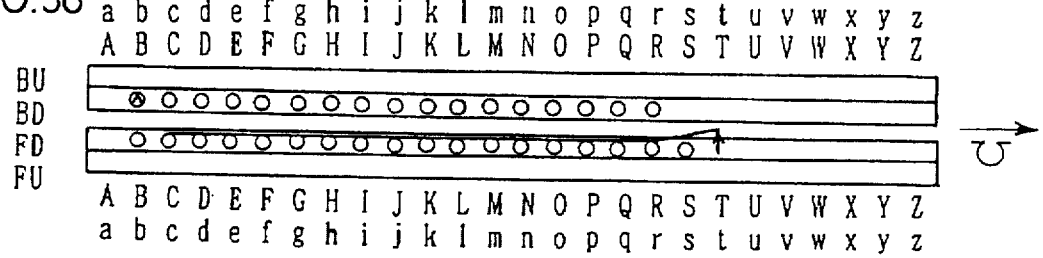

The yarn is fed to form a row of loops on the knitting needles R to C of the lower rear needle bed BD and its end is tucked on the knitting needle B which remains unoccupied, as shown in FIG. 37. Then, the yarn is fed to form a row of loops on the knitting needles C to R of the lower front needle bed FD, as shown in FIG. 38.

Figure 39:
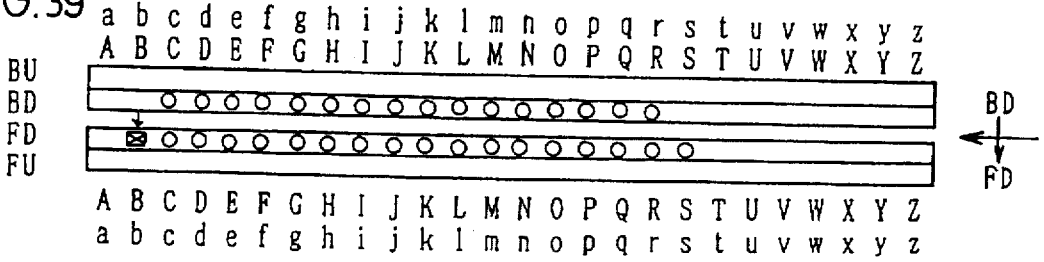
Figure 40:
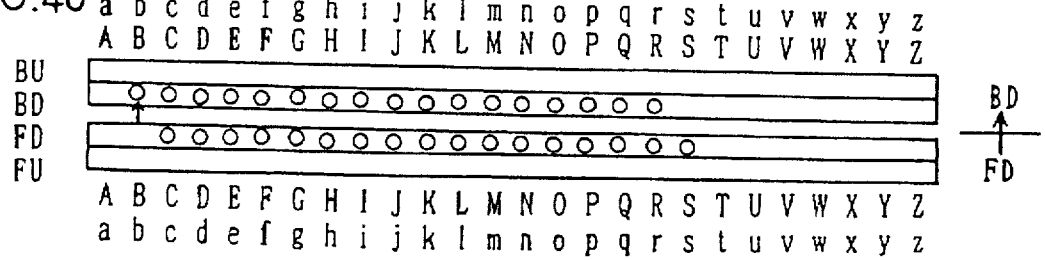

As shown in FIG. 39, the tucked yarn on the knitting needle B of the lower rear needle bed BD is transferred onto the knitting needle B of the lower front needle bed FD. It is then transferred back to the knitting needle B of the lower rear needle bed BD, as shown in FIG. 40.

Figure 41:
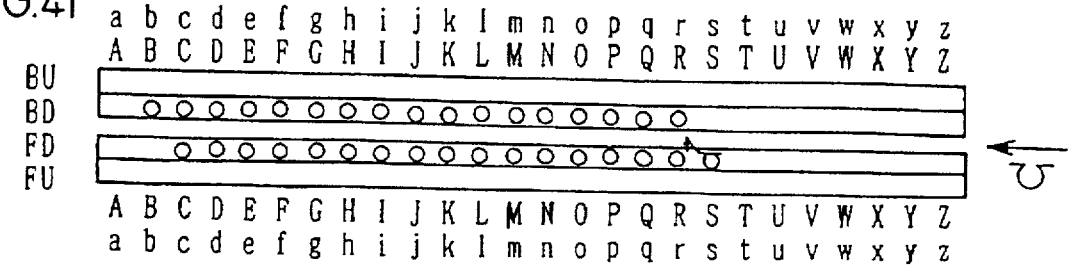
Figure 42:
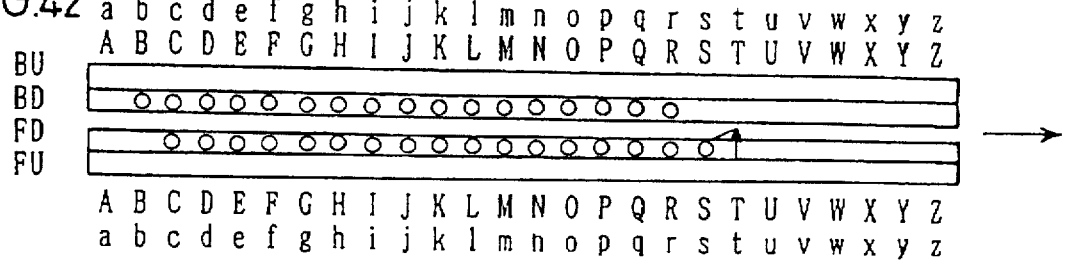
Figure 43:
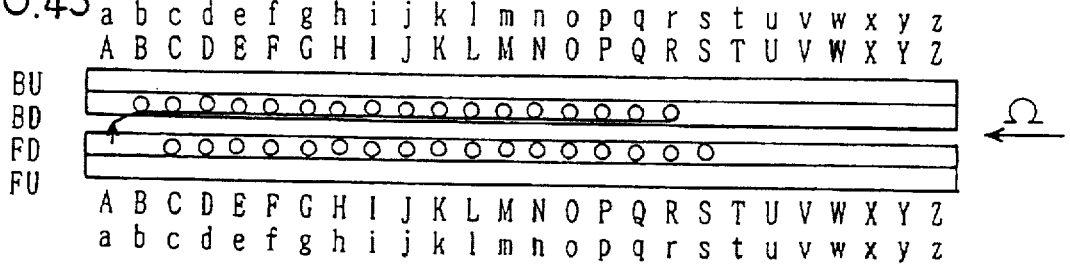

The yarn from the feeder is threaded from right to left to form a loop on the knitting needle S of the lower front needle bed FD, as shown in FIG. 41. The feeder is removed out from the knitting area, as shown in FIG. 42, and the yarn is fed to form a row of loops on the knitting needles R to B of the lower rear needle bed BD, as shown in FIG. 43.

Figure 44:
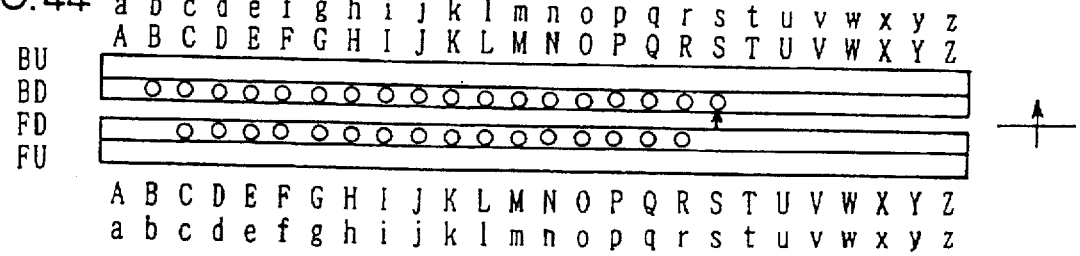
Figure 45:
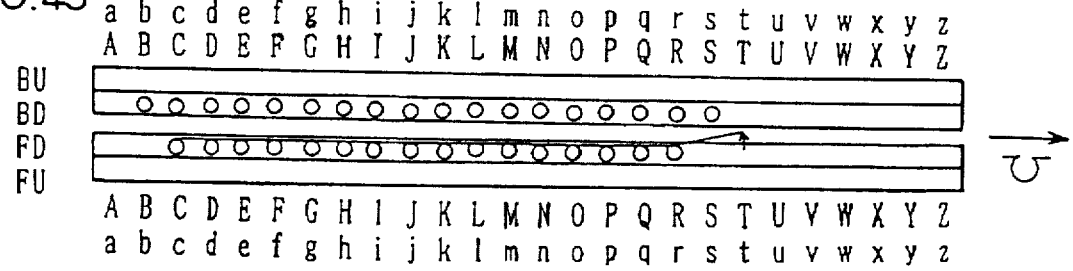

The loop on the knitting needle S of the lower front needle bed FD is transferred onto the knitting needle S of the lower rear needle bed BD, as shown in FIG. 44, and the yarn is fed to form another row of loops on the knitting needles C to R of the lower front needle bed FD, as shown in FIG. 45.

As a result of the procedures through the courses illustrated in FIGS. 33 to 45, the number of wales is increased by two as the loops on the knitting needles C to R of the needle bed BD turn to those on the knitting needles B to S.

Figure 46:
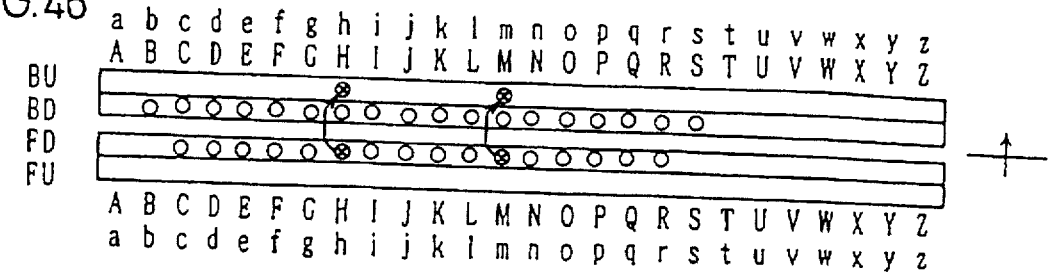
Figure 47:
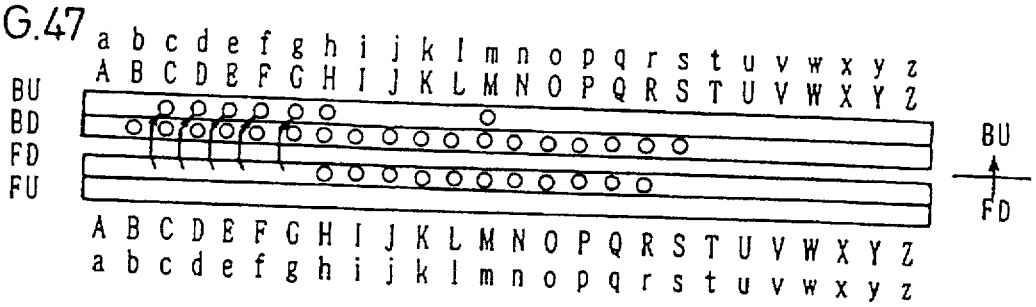

The two loops on the knitting needles H and M of the lower front needle bed FD are transferred by split stitch onto the knitting needle h and m of the upper rear needle bed BU respectively, as shown in FIG. 46. Then, the loops on the knitting needles C to G of the lower front needle bed FD are transferred onto the knitting needles c to g of the upper rear needle bed BU, as shown in FIG. 47.

Figure 48:
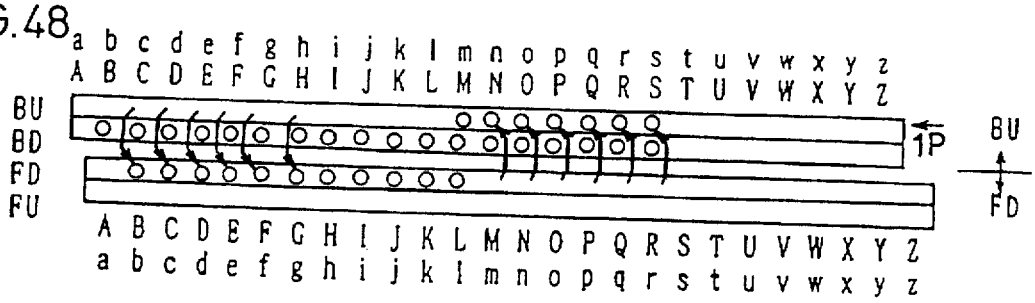
Figure 49:
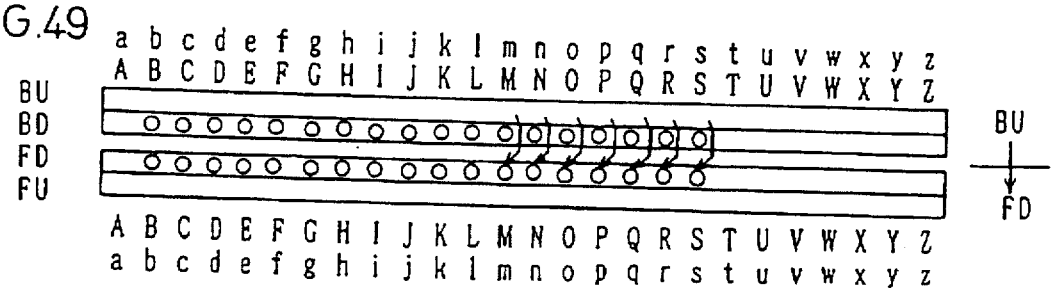

The two rear needle beds BD,BU are moved one knitting needle distance to the left by racking and the loops on the knitting needles c to h of the upper rear needle bed BU are transferred onto the knitting needles B to G of the lower front needle bed FD, as shown in FIG. 48. Simultaneously, the loops on the knitting needles M to R of the lower front needle bed FD are transferred onto the knitting needles n to s of the upper rear needle bed BU. In succession, the two rear needle beds BD,BU are moved back by one knitting needle distance to the right and the loops on the knitting needles m to s of the upper rear needle bed BU are transferred onto the knitting needles M to S of the lower front needle bed FD, as shown in FIG. 49.

Figure 50:
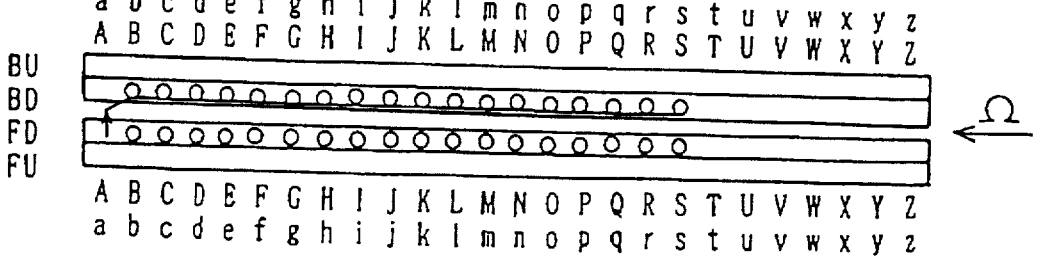
Figure 51:
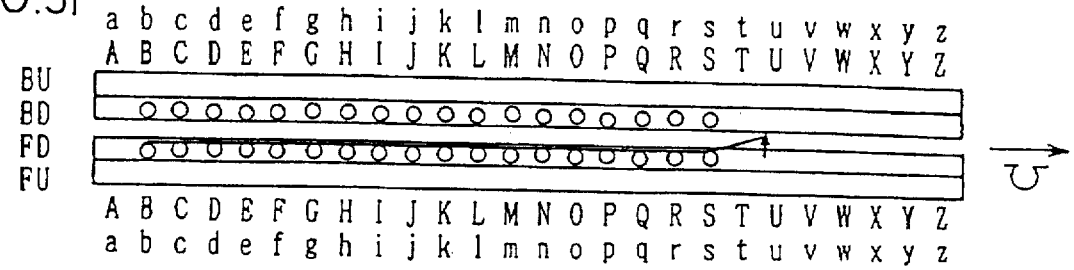
Figure 52:
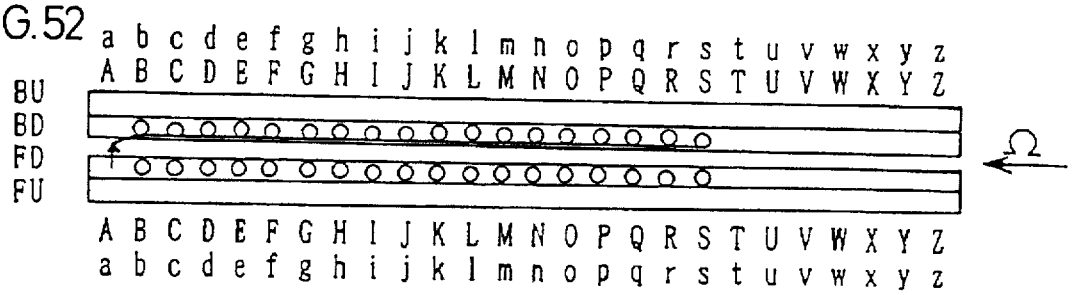
Figure 53:
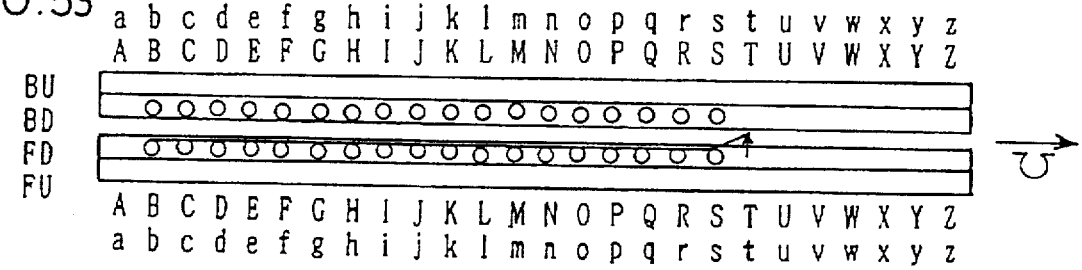

As shown in FIG. 50, the yarn is fed to form a row of loops on the knitting needles S to B of the lower rear needle bed BD. Then, the yarn is further fed to form another row of loops on the knitting needles B to S of the lower front needle bed FD, as shown in FIG. 51, and also, threaded to form a further row of loops on the knitting needles S to B of the lower rear needle bed BD, as shown in FIG. 52. Finally, the yarn is fed to form a row of loops on the knitting needles B to S of the lower front needle bed FD, as shown in FIG. 53.

As the result, the loops on the knitting needles C to R of the lower front needle bed FD shown in FIG. 45 are turned to the loops on the knitting needles B to S, thus increasing the wales by two.

A series of the courses shown in FIGS. 33 to 52 are repeated from FIG. 54 to FIG. 73 so that the wales are increased in number.

Figure 54:
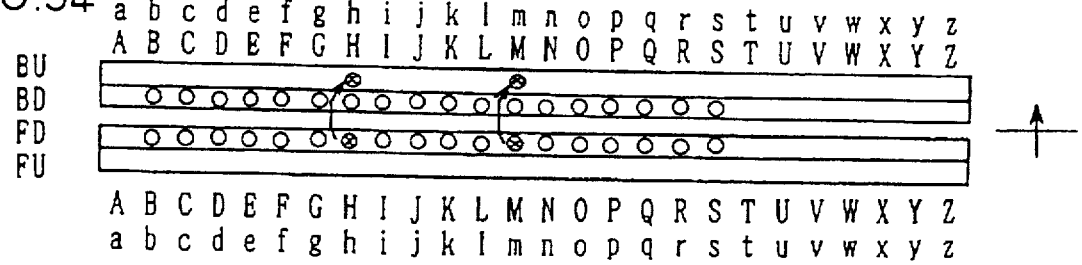
Figure 55:
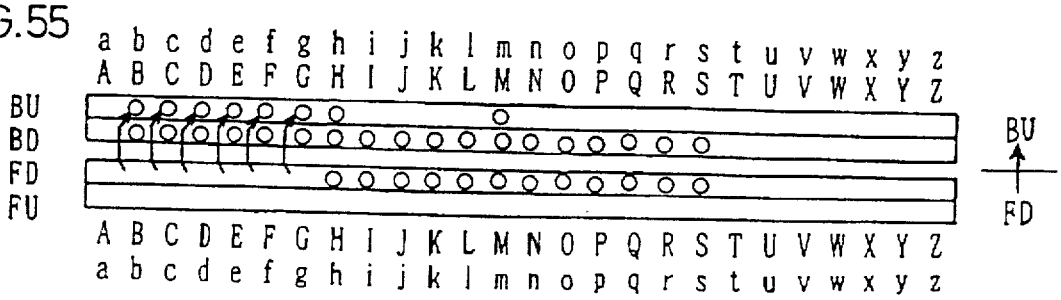

More particularly, the two loops on the knitting needles H and M of the lower front needle bed FD are transferred by split stitch onto the knitting needle h and m of the upper rear needle bed BU respectively, as shown in FIG. 54. Then, the loops on the knitting needles B to G of the lower front needle bed FD are transferred onto the knitting needles b to g of the upper rear needle bed BU, as shown in FIG. 55.

Figure 56:
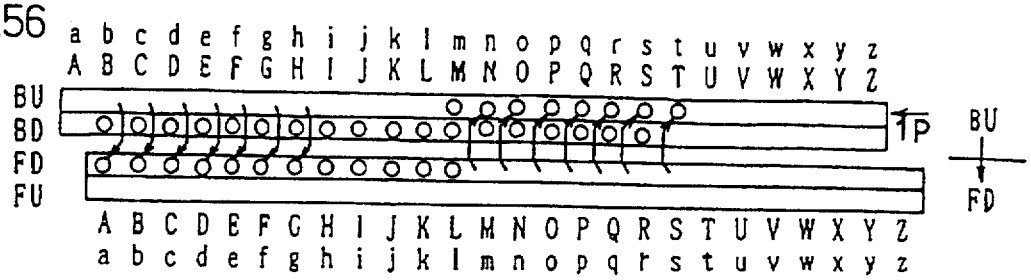
Figure 57:
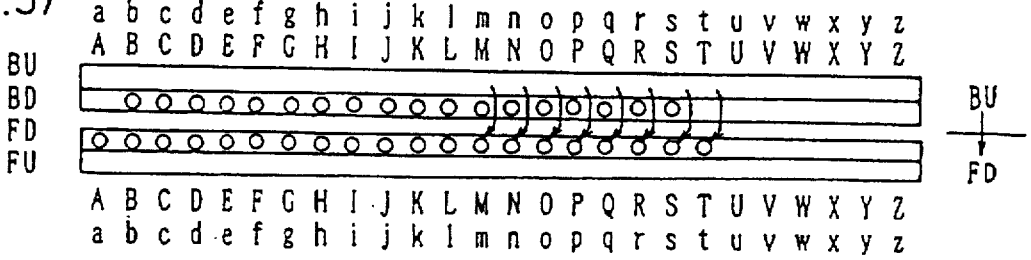

The two rear needle beds BD,BU are moved one knitting needle distance to the left by racking and the loops on the knitting needles b to h of the upper rear needle bed BU are transferred onto the knitting needles A to G of the lower front needle bed FD, as shown in FIG. 56. Simultaneously, the loops on the knitting needles M to S of the lower front needle bed FD are transferred onto the knitting needles n to t of the upper rear needle bed BU. In succession, the two rear needle beds BD,BU are moved back by one knitting needle distance to the right and the loops on the knitting needles m to t of the upper rear needle bed BU are transferred onto the knitting needles M to T of the lower front needle bed FD, as shown in FIG. 57.

Figure 58:
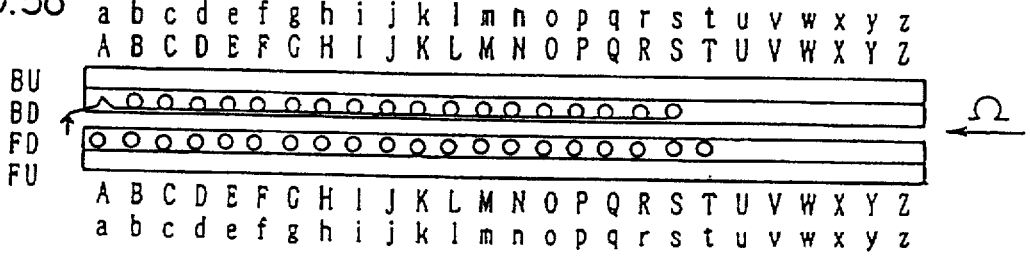
Figure 59:
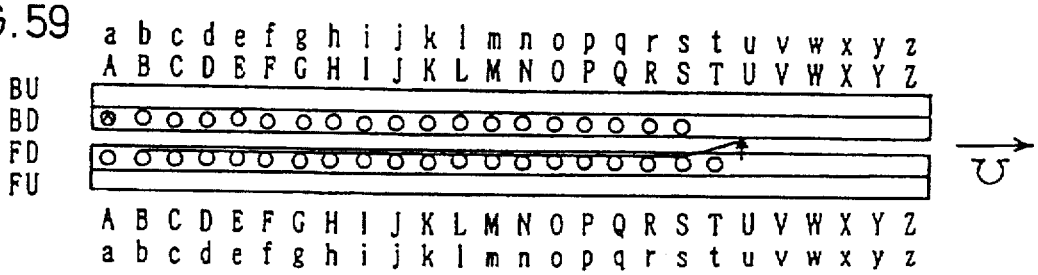

As shown in FIG. 58, the yarn is fed to form a row of loops on the knitting needles S to B of the lower rear needle bed BD and its end is tucked on the knitting needle A which remains unoccupied. The yarn is then fed to form a row of loops on the knitting needles B to S of the lower front needle bed FD, as shown in FIG. 59.

Figure 60:
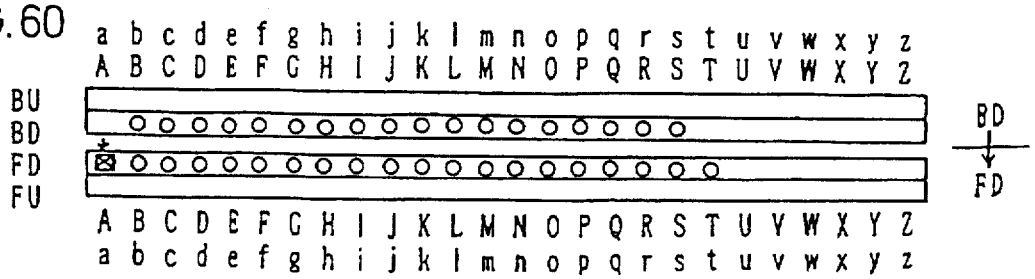
Figure 61:
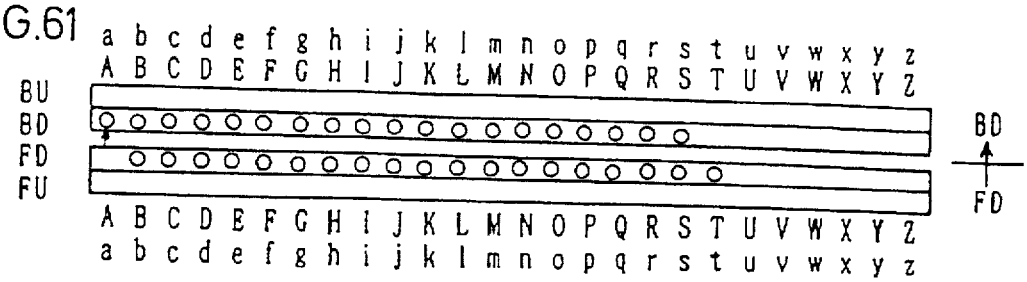

The tucked yarn on the knitting needle A of the lower rear needle bed BD shown in FIG. 58 is transferred onto the knitting needle A of the lower front needle bed FD, as shown in FIG. 60. It is then transferred back to the knitting needle A of the lower rear needle bed BD, as shown in FIG. 62.

Figure 62:
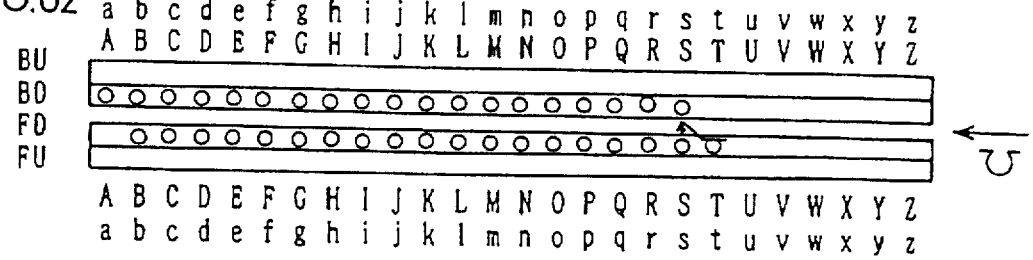
Figure 63:
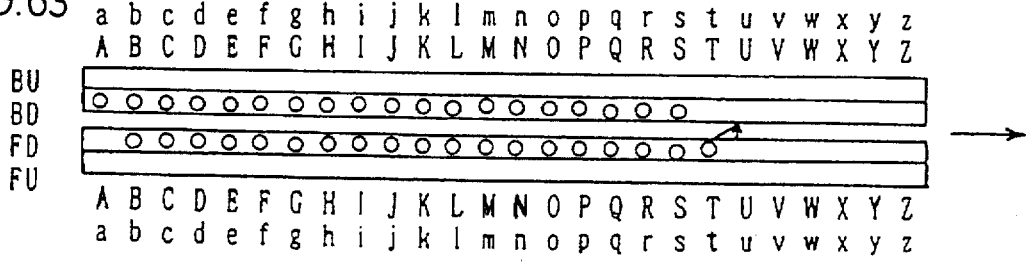
Figure 64:
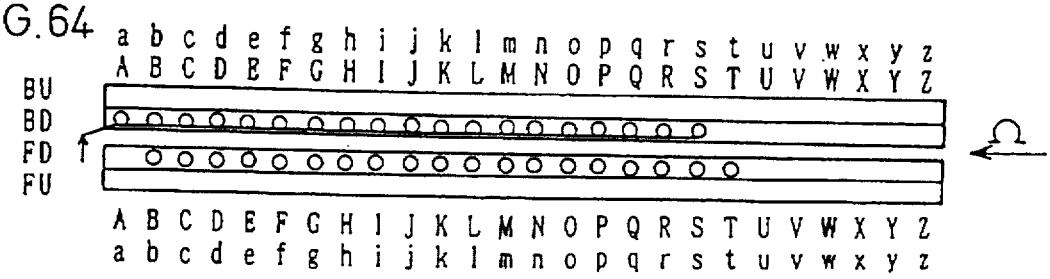

The yarn from the feeder is threaded from right to left to form a loop on the knitting needle T of the lower front needle bed FD, as shown in FIG. 62. The feeder is rightwardly removed out from the knitting area, as shown in FIG. 63, and the yarn is fed to form a row of loops on the knitting needles S to A of the lower rear needle bed BD, as shown in FIG. 64.

Figure 65:
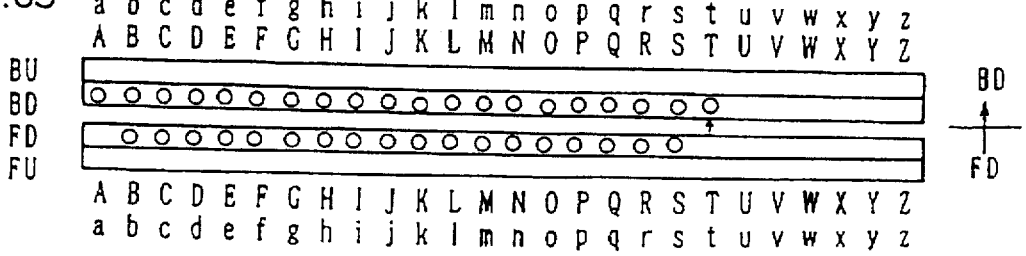
Figure 66:
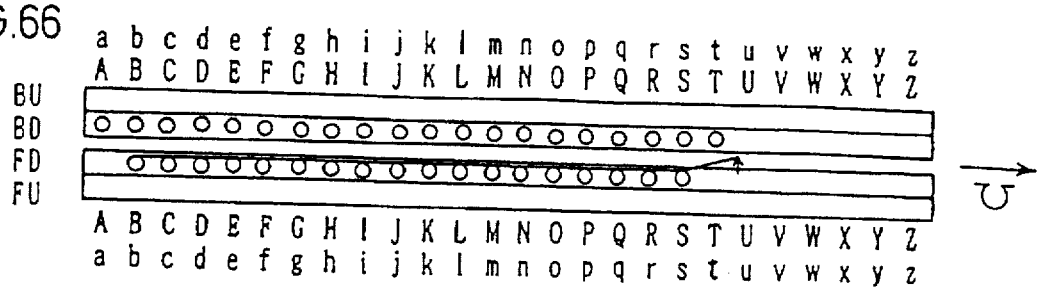

The loop on the knitting needle T of the lower front needle bed FD is transferred onto the knitting needle T of the lower rear needle bed BD, as shown in FIG. 65, and the yarn is fed to form another row of loops on the knitting needles B to S of the lower front needle bed FD, as shown in FIG. 66.

As a result of the procedures through the courses illustrated in FIGS. 54 to 66, the number of wales is further increased by two as the loops on the knitting needles B to S of the needle bed BD turn to those on the knitting needles A to T.

Figure 67:
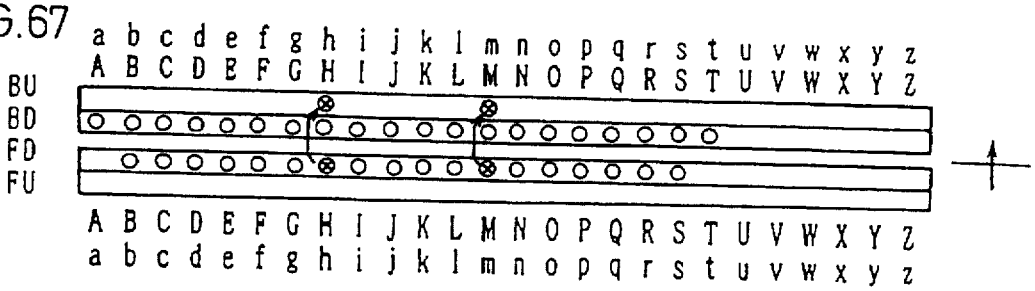
Figure 68:
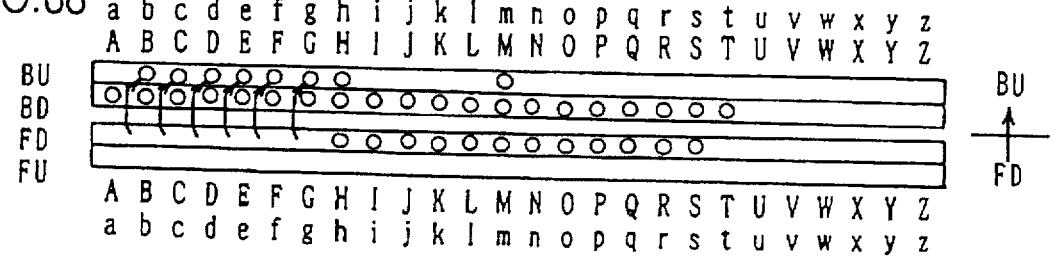

Also, the two loops on the knitting needles H and M of the lower front needle bed FD are transferred by split stitch onto the knitting needle h and m of the upper rear needle bed BU respectively, as shown in FIG. 67. Then, the loops on the knitting needles B to G of the lower front needle bed FD are transferred onto the knitting needles b to g of the upper rear needle bed BU, as shown in FIG. 68.

Figure 69:
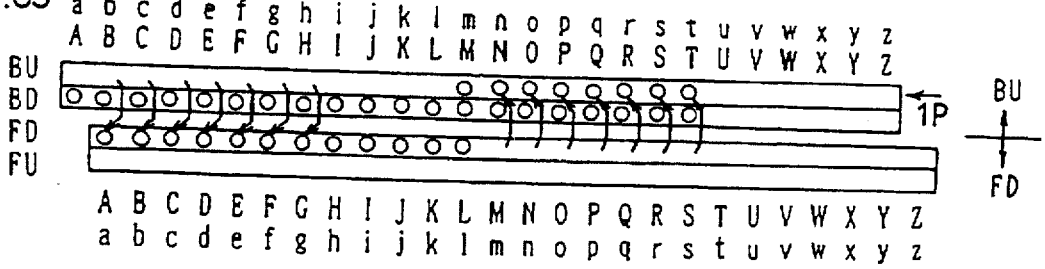
Figure 70:
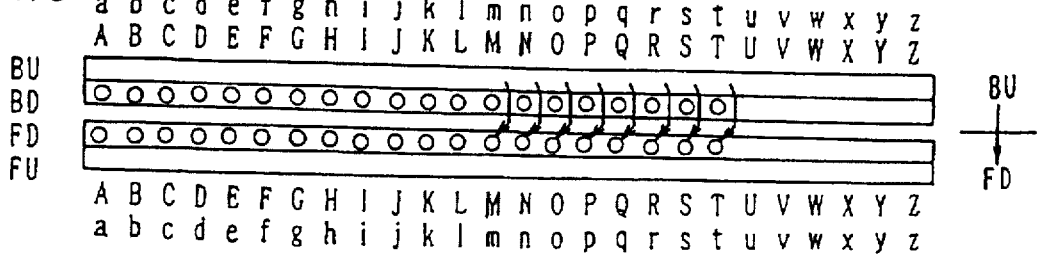

The two rear needle beds BD,BU are moved one knitting needle distance to the left by racking and the loops on the knitting needles b to h of the upper rear needle bed BU are transferred onto the knitting needles A to G of the lower front needle bed FD, as shown in FIG. 69. Simultaneously, the loops on the knitting needles M to S of the lower front needle bed FD are transferred onto the knitting needles n to t of the upper rear needle bed BU. In succession, the two rear needle beds BD,BU are moved back by one knitting needle distance to the right and the loops on the knitting needles m to t of the upper rear needle bed BU are transferred onto the knitting needles M to T of the lower front needle bed FD, as shown in FIG. 70.

Figure 71:
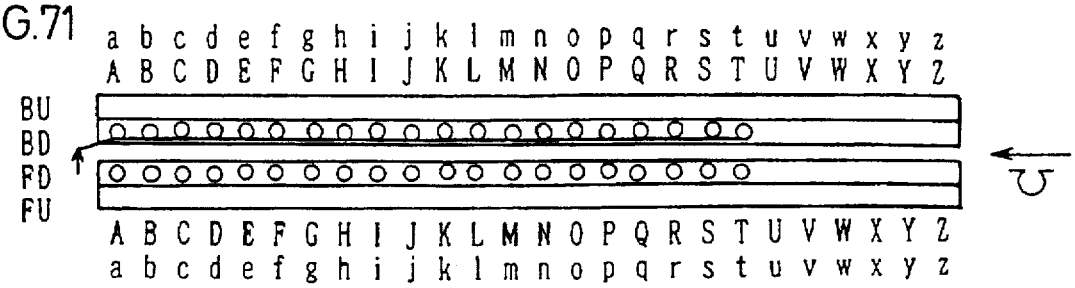
Figure 72:
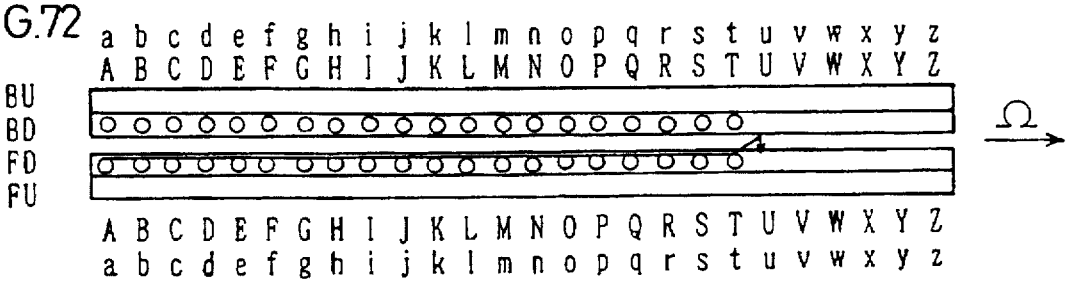

As illustrated in FIG. 71, the yarn is fed to form a row of loops on the knitting needles T to A of the lower rear needle bed BD. Then, the yarn is further fed to form another row of loops on the knitting needles A to T of the lower front needle bed FD, as shown in FIG. 72, and also, threaded to form a further row of loops on the knitting needles T to A of the lower rear needle bed BD, as shown in FIG. 73.

As the result, the loops on the knitting needles B to S of the lower front needle bed FD shown in FIG. 66 are turned to the loops on the knitting needles A to T, thus increasing the wales by two.

The resultant tubular knitted fabric has a front-to-back asymmetrical shape in which the front half is composed of a less number of wales, as best shown in FIG. 75. The back half has both side ends extending to the front for joining to the front half.

It should be understood that the two front needle beds FD,FU may be moved by racking although the racking movement of the two rear needle beds BD,BU only is implemented in the embodiment.

Figure 76:
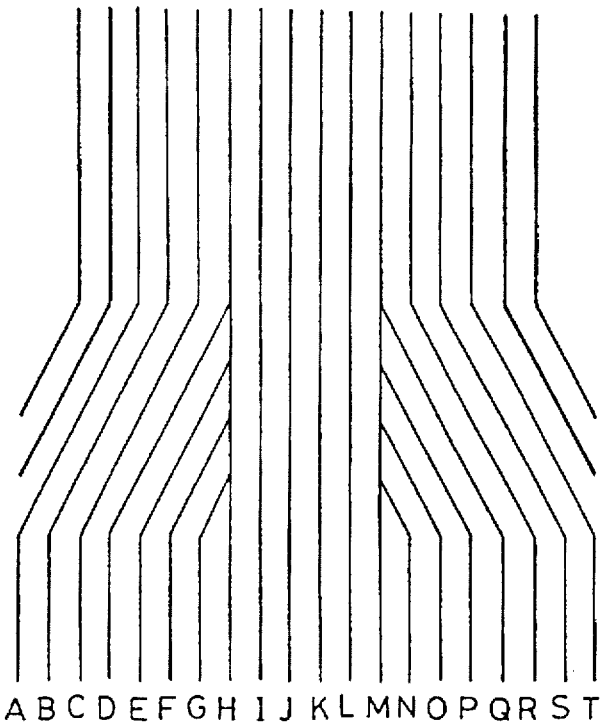
FIG. 76 is a front view showing a modification of the constricted portion of the tubular knitted fabric produced by the method of the present invention.
Figure 77:
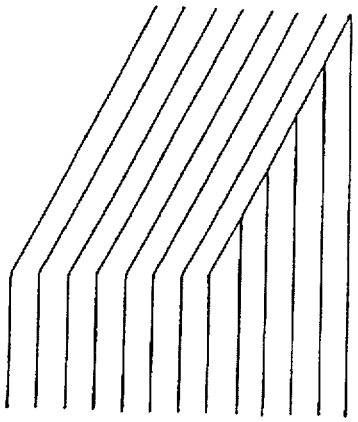
FIG. 77 is a front view showing another modification of the constricted portion of the tubular knitted fabric produced by the method of the present invention.
Figure 78:
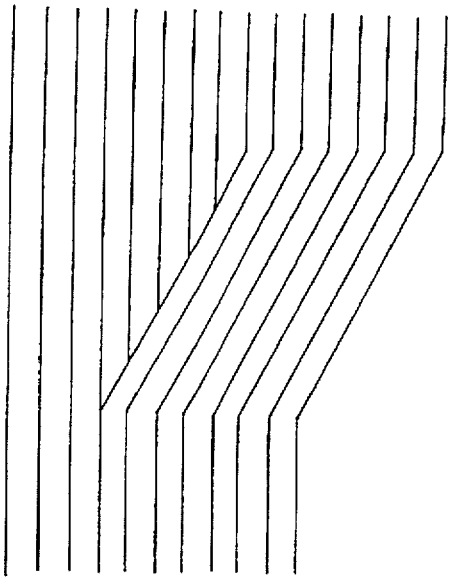
FIG. 78 is a front view showing a further modification of the constricted portion of the tubular knitted fabric produced by the method of the present invention.
Figure 79:
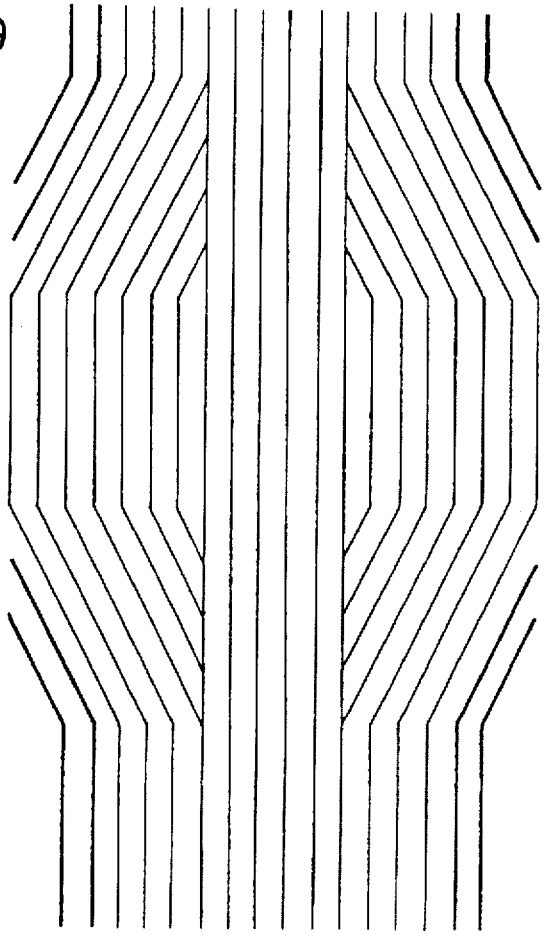
FIG. 79 is a front view showing a still further modification of the constricted portion of the tubular knitted fabric produced by the method of the present invention.

Although the waist constricted part of the tubular fabric is knitted by decreasing the number of wales at both the side ends of the front half, it may be produced by decreasing the number of wales at one side end of the front half, as shown in FIG. 76, by increasing the number of wales at the side end of the same, as shown in FIG. 77, or by increasing the number of wales at the two side ends and then, decreasing the same for forming extensions, as shown in FIG. 77. Also, a three-dimensional silhouette form of the tubular fabric may be produced using any combination of the foregoing techniques.

What is claimed is:

1. A method of knitting a tubular fabric with a flat knitting machine having an upper front needle bed, a lower front needle bed, an upper rear needle bed and a lower rear needle bed, each needle bed having a plurality of knitting needles, the tubular fabric consisting of a front part knitted with knitting needles of the lower front needle bed and a back part knitted with knitting needles on the lower rear needle bed, comprising:

feeding a yarn to the knitting needles of the lower front needle bed and forming loops of the front part, and succeedingly feeding the yarn to the knitting needles of the lower rear needle bed and forming loops of the back part;

selecting a number of knitting needles from the knitting needles of the lower front needle bed for knitting the front part, feeding yarn to the selected number of knitting needles and forming loops of the front part, the selected number is less than the number of knitting needles of the lower rear needle bed used for knitting the back part;

feeding the yarn to the knitting needles of the lower rear needle bed in a direction along a longitudinal length of the lower rear needle bed except to the knitting needle placed at an end in the knitting direction and forming loops of the back part;

feeding the yarn to the excepted knitting needle in an opposite direction along a longitudinal length of the lower rear needle bed and forming a loop of the back part;

feeding the yarn to the selected number of knitting needles of the lower front needle bed and forming loops; and transferring the loop formed on the excepted knitting needle of the lower rear needle bed to a knitting needle of the lower front needle bed.

2. A method of knitting a tubular fabric with a flat knitting machine having an upper front needle bed, a lower front needle bed, an upper rear needle bed and a lower rear needle bed, each needle bed having a plurality of knitting needles, the tubular fabric consisting of a front part knitted with knitting needles of the lower front needle bed and a back part knitted with knitting needles of the lower rear needle bed, comprising:

feeding a yarn to the knitting needles of the lower front needle bed and forming loops of the front part, and succeedingly feeding the yarn to the knitting needles of the lower rear needle bed and forming loops of the back part;

selecting a number of knitting needles from the knitting needles of the lower front needle bed for knitting the front part, feeding yarn to the selected number of knitting needles and forming loops of the front part, the selected number is less than the number of knitting needles of the lower rear needle bed used for knitting the back part;

hooking the yarn by a knitting needle adjacent to the selected number of knitting needles;

feeding the yarn to the knitting needles of the lower rear needle bed in a direction along a longitudinal length of the lower rear needle bed except to a knitting needle placed at a start in the direction and forming loops of the back part;

transferring the hooked yarn to the excepted knitting needle of the lower rear needle bed by knocking over the loop on the excepted knitting needle of the lower rear needle bed, where the hooked yarn forms a loop of the back part; and returning the loop back to the knitting needle of the lower front needle bed.

3. A method of knitting a tubular fabric with a flat knitting machine having an upper front needle bed, a lower front needle bed, an upper rear needle bed and a lower rear needle bed, each needle bed having a plurality of knitting needles, the tubular fabric consisting of a front part knitted with knitting needles of the lower rear needle bed and a back part knitted with knitting needles of the lower rear needle bed, comprising:

feeding a yarn to the knitting needles of the lower front needle bed and forming loops of the front part, and succeedingly feeding the yarn to the knitting needles of the lower rear needle bed and forming loops of the back part;

transferring the loops on the knitting needles (A to G) of the lower front needle bed to the knitting needles (a to g) of the upper rear needle bed, and transferring the loops on the knitting needles (N to T) of the lower front needle bed to the knitting needle (n to t) of the upper rear needle bed;

transferring the loops on the knitting needles (a to g) of the upper rear needle bed to the knitting needles (B to H) of the lower front needle bed so that the loop on the knitting needle (g) of the upper rear needle bed overlaps the loop on the knitting needle (H) of the lower front needle bed;

transferring the loops on the knitting needles (n to t) of the upper rear needle bed to the knitting needles (M to S) of the lower front needle bed so that the loop on the knitting needle (n) of the upper rear needle bed overlaps the loop on the knitting needle (M) of the lower front needle bed, decreasing the number of loops of the front part by two in which the number is less than the number of knitting needles of the lower rear needle bed used for knitting the back part;

feeding the yarn to the knitting needles (B to S) of the lower front needle bed and forming loops of the front part;

feeding the yarn to the knitting needles (T to B) of the lower needle bed in a direction along a longitudinal length of the lower rear needle bed except to the knitting needle (A) placed at an end in the feeding direction and forming loops of the back part;

feeding the yarn to the excepted knitting needle (A) in an opposite direction along a longitudinal length of the lower rear needle bed and forming a loop of the back part;

feeding the yarn to the knitting needles (B to S) of the lower front needle bed and forming loops;

transferring the loops formed on the knitting needles (B to G) of the lower front needle bed to the knitting needles (b to g) of the upper rear needle bed;

transferring the loops on the knitting needles (b to g) of the upper rear needle bed to the knitting needles (C to H) of the lower front needle bed so that the loop on the knitting needle (g) of the upper rear needle bed overlaps the loop on the knitting needle (H) of the lower front needle bed and transferring the loop formed on the excepted knitting needle (A) of the lower rear needle bed to a knitting needle (B) of the lower front needle bed.

4. A method of knitting a tubular fabric with a flat knitting machine having an upper front needle bed, a lower front needle bed, an upper rear needle bed and a lower rear needle bed, each needle bed having a plurality of knitting needles, the tubular fabric consisting of a front part knitted with knitting needles of the lower rear needle bed and a back part knitted with knitting needles of the lower rear needle bed, comprising:

feeding a yarn to the knitting needles of the lower front needle bed and forming loops of the front part, and succeedingly feeding the yarn to the knitting needles of the lower rear needle bed and forming loops of the back part;

transferring the loops on the knitting needles (A to G) of the lower front needle bed to the knitting needles (a to g) of the upper rear needle bed, and transferring the loops on the knitting needles (N to T) of the lower front needle bed to the knitting needle (n to t) of the upper rear needle bed;

transferring the loops on the knitting needles (a to g) of the upper rear needle bed to the knitting needles (B to H) of the lower front needle bed so that the loop on the knitting needle (g) of the upper rear needle bed overlaps the loop on the knitting needle (H) of the lower front needle bed;

transferring the loops on the knitting needles (n to t) of the upper rear needle bed to the knitting needles (M to S) of the lower front needle bed so that the loop on the knitting needle (n) of the upper rear needle bed overlaps the loop on the knitting needle (M) of the lower front needle bed, decreasing the number of loops of the front part by two in which the number is less than the number of knitting needles of the lower rear needle bed used for knitting the back part;

feeding the yarn to the knitting needles (B to S) of the lower front needle bed and forming loops of the front part, hooking the yarn by a knitting needle (T) adjacent to the knitting needles (B to S) of the lower front needle bed;

feeding the yarn to the knitting needles (S to B) of the lower rear needle bed in a direction along a longitudinal length of the lower rear needle bed except to the knitting needle (T) placed at a start in the direction and forming loops of the back part;

transferring the loops on the knitting needles (N to S) of the lower front needle bed to the knitting needles (n to s) of the upper rear needle bed and transferring the hooked yarn to the excepted knitting needle (T) of the lower rear needle bed by knocking over the loop on the excepted knitting needle (T) of the lower rear needle bed, where the hooked yarn forms a loop of the back part; and transferring the loops on the knitting needles (n to s) of the upper rear needle bed to the knitting needles (M to R) of the lower front needle bed so that the loop on the knitting needle (n) of the upper rear needle bed overlaps the loop on the knitting needle (M) of the lower front needle bed and returning the loop on the knitting needle (T) of the lower rear needle bed back to the knitting needle (S) of the lower front needle bed.

5. A method of knitting a tubular fabric with a flat knitting machine having an upper front needle bed, a lower front needle bed, an upper rear needle bed and a lower rear needle bed, each needle bed having a plurality of knitting needles, the tubular fabric consisting of a front part knitted with knitting needles of the lower front needle bed and a back part knitted with knitting needles of the lower rear needle bed, comprising:

feeding a yarn to the knitting needles (C to R) of the lower front needle bed and forming loops of the front part, splitting the loops on the knitting needles (H and M) of the lower front needle bed and transferring the loops to the knitting needles (h and m) of the upper rear needle bed, respectively;

transferring the loops on the knitting needles (C to G) of the lower front needle bed to the knitting needles (c to g) of the upper rear needle bed;

transferring the loops on the knitting needles (c to h) of the upper rear needle bed to the knitting needles (B to G) of the lower front needle bed, and transferring the loops on the knitting needles (M to R) of the lower front needle bed to the knitting needles (n to s) of the upper rear needle bed;

transferring the loops on the knitting needles (m to s) of the upper rear needle bed to the knitting needles (M to S) of the lower front needle bed, whereby the number of loops of the front part is increased by two in which the increased number is larger than the number of knitting needles of the lower rear needle bed used for knitting the back part;

feeding the yarn to the knitting needles (R to C) of the lower rear needle bed and forming loops of the back part;

feeding the yarn to the knitting needles (C to R) of the lower front needle bed in a direction along a longitudinal length of the lower front needle bed except to the knitting needles (B and S) placed at a start and an end in the feeding direction and forming loops of the front part;

feeding the yarn to the excepted knitting needle (s) in another direction along a longitudinal length of the lower front needle bed and forming a loop of the front part;

feeding the yarn to the knitting needles (R to B) of the lower rear needle bed and forming loops;

transferring the loops formed on the excepted knitting needle (S) of the lower front needle bed to the knitting needle (S) of the lower front needle bed to a knitting needle (S) of the lower rear needle bed;

feeding the yarn to the knitting needles (C to R) of the lower front needle bed and forming loops of the front part;

splitting the loops on the knitting needles (H and M) of the lower front needle bed and transferring the split loops to the knitting needles (h and m) of the upper rear needle bed, respectively;

transferring the loops on the knitting needles (C to G) of the lower front needle bed to the knitting needles (c to g) of the upper rear needle bed;

transferring the loops on the knitting needles (c to h) of the upper rear needle bed to the knitting needles (B to G) of the lower front needle bed, and transferring the loops on the knitting needles (M to R) of the lower front needle bed to the knitting needles (n to s) of the upper rear needle bed; and transferring the loops on the knitting needles (m to s) of the upper rear needle bed to the knitting needles (M to S) of the lower front needle bed.

6. A method of knitting a tubular fabric with a flat knitting machine having an upper front needle bed, a lower front needle bed, an upper rear needle bed and a lower rear needle bed, each needle bed having a plurality of knitting needles, the tubular fabric consisting of a front part knitted with knitting needles of the lower front needle bed and a back part knitted with knitting needles of the lower rear needle bed, comprising:

feeding a yarn to the knitting needles (C to R) of the lower front needle bed and forming loops of the front part, splitting the loops on the knitting needles (H and M) of the lower front needle bed and transferring the split loops to the knitting needles (h and m) of the upper rear needle bed, respectively;

transferring the loops on the knitting needles (C to G) of the lower front needle bed to the knitting needles (c to g) of the upper rear needle bed;

transferring the loops on the knitting needles (c to h) of the upper rear needle bed to the knitting needles (B to G) of the lower front needle bed, and transferring the loops on the knitting needles (M to R) of the lower front needle bed to the knitting needles (n to s) of the upper rear needle bed;

transferring the loops on the knitting needles (m to s) of the upper rear needle bed to the knitting needles (M to S) of the lower front needle bed, whereby the number of loops of the front part is increased by two in which the increased number is larger than the number of knitting needles of the lower rear needle bed used for knitting the back part;

feeding the yarn to the knitting needles (R to C) of the lower rear needle bed and forming loops of the rear part and hooking the yarn by a knitting needle (B) adjacent to the knitting needles (R to C) of the lower rear needle bed;

feeding the yarn to the knitting needles (C to R) of the lower front needle bed in a direction along a longitudinal length of the lower front needle bed except to the knitting needles (B and S) placed at a start and an end in the feeding direction and forming loops of the front part;

transferring the hooked yarn to the excepted knitting needle (B) of the lower front needle bed by knocking over the loop on the excepted knitting needle (B) of the lower front needle bed, where the hooked yarn forms a loop of the front part;

returning the loop back to the knitting needle (B) of the lower rear needle bed;

feeding the yarn to the knitting needles (R to B) of the lower rear needle bed and forming loops;

feeding the yarn to the knitting needles (C to R) of the lower front needle bed and forming loops of the front part;

splitting the loops on the knitting needles (H and M) of the lower front needle bed and transferring the split loops to the knitting needles (h and m) of the upper rear needle bed, respectively;

transferring the loops on the knitting needles (C to G) of the lower front needle bed to the knitting needles (c to g) of the upper rear needle bed;

transferring the loops on the knitting needles (c to h) of the upper rear needle bed to the knitting needles (B to G) of the lower front needle bed, and transferring the loops on the knitting needles (M to R) of the lower front needle bed to the knitting needles (n to s) of the upper rear needle bed; and transferring the loops on the knitting needles (m to s) of the upper rear needle bed to the knitting needles (M to S) of the lower front needle bed.

* * * * *